US010351303B2

(12) United States Patent
Huang

(10) Patent No.: US 10,351,303 B2
(45) Date of Patent: Jul. 16, 2019

(54) ORIGAMI ENVELOPE

(71) Applicant: Bor-Jiun Huang, Burnaby (CA)

(72) Inventor: Bor-Jiun Huang, Burnaby (CA)

( * ) Notice: Subject to any disclaimer, the term of this patent is extended or adjusted under 35 U.S.C. 154(b) by 0 days.

(21) Appl. No.: 15/713,461

(22) Filed: Sep. 22, 2017

(65) Prior Publication Data

US 2018/0009572 A1 Jan. 11, 2018

Related U.S. Application Data

(63) Continuation-in-part of application No. 15/011,178, filed on Jan. 29, 2016, now Pat. No. 9,796,509.

(51) Int. Cl.

| | |
|---|---|
| ***B65D 27/00*** | (2006.01) |
| ***B65D 27/12*** | (2006.01) |
| ***B31B 70/26*** | (2017.01) |
| ***B65D 27/28*** | (2006.01) |
| *B31B 160/10* | (2017.01) |

(52) U.S. Cl.

CPC ..... *B65D 27/12* (2013.01); *B31B 70/26* (2017.08); *B65D 27/00* (2013.01); *B65D 27/28* (2013.01); *B31B 2160/102* (2017.08)

(58) Field of Classification Search

CPC ..... B65D 27/12; B65D 27/00; B65D 27/28; B31B 70/26; B31B 2160/102

USPC ..... 229/75

See application file for complete search history.

(56) References Cited

U.S. PATENT DOCUMENTS

| | | | |
|---|---|---|---|
| 284,297 | A | 9/1883 | Hartwell |
| 665,796 | A | 1/1901 | Myers |
| 941,525 | A | 11/1909 | Landenberger |
| 2,005,493 | A | 6/1935 | Blackwell |
| 2,021,620 | A | 11/1935 | Gordon |
| 4,744,509 | A | 5/1988 | Buchler-Dopheide |
| 4,809,904 | A | 3/1989 | Yasutaniya |
| 4,992,310 | A | 2/1991 | Gelb |
| 5,024,373 | A | 6/1991 | Riel |
| 5,279,456 | A | 1/1994 | Bernstein |
| 6,006,457 | A | 12/1999 | Transport |
| 6,016,908 | A | 1/2000 | Gaetano |
| 6,056,192 | A | 5/2000 | Cameron |
| 6,612,433 | B2 | 9/2003 | McKenzie |
| D520,057 | S | 5/2006 | Hamel |
| 2003/0222127 | A1 | 12/2003 | Katz |
| 2006/0283922 | A1 | 12/2006 | Hurwitz |

OTHER PUBLICATIONS

Fai, www.aslialtay.com/Open_City.html. Accessed Apr. 10, 2017.
Superkitina, "52 Weeks of Mail: Celine", www.superkitina.wordpress.com/2012/06/11/52-weeks-of-mail-celine/. Accessed Apr. 10, 2017.

(Continued)

*Primary Examiner* — Peter N Helvey

(74) *Attorney, Agent, or Firm* — Oyen Wiggs Green & Mutala LLP

(57) ABSTRACT

An origami envelope and a method of constructing the origami envelope are enclosed. The origami envelope is quadrilateral in shape. The origami envelope comprises a top layer having a front surface and a back surface opposite to the front surface, and a bottom layer having an exterior side and an interior side opposite to the exterior side. The top layer extends to the exterior side of the bottom layer over a portion of the top envelope side to form a closure flap at the exterior side of the bottom layer.

15 Claims, 18 Drawing Sheets

(56) References Cited

OTHER PUBLICATIONS

Pinterest, "Explore Envelope Approx, Envelope Folding, and more!", www.pinterest.com/pin/530861874798925314/. Accessed Apr. 10, 2017.
Andrew Zo, "Origami Envelope", www.andrewzo.com/portfolioorigami-envelope/. Accessed Apr. 10, 2017.
"Maaemo". www.bureaubruneau.com/pro-maaemo.html. Accessed Apr. 10, 2017.
"Envelope traditional", Diagrams © 2005, Marc Kirschenbaum.

ORIGAMI ENVELOPE

TECHNICAL FIELD

This invention relates to envelopes, and methods of making same.

BACKGROUND

Numerous envelopes are used on a daily basis, to deliver messages or objects such as letters, notes, cards, gift cards, coupons, promotional materials, and money from one person to another. Conventional envelopes can be environmentally wasteful and costly because such envelopes are typically limited to a one-time use once the envelope has been printed on, or is sealed.

Origami envelopes (envelopes made from a folded piece of paper) can be substituted for conventional envelopes. However, existing origami envelopes are typically folded in a way such that the folded envelopes are oddly-shaped and sized and/or do not resemble conventional envelopes in shape or function. Such designs of folded envelopes are impractical since these oddly-shaped and sized envelopes may be more prone to being lost in the mail, and/or may not hold objects which are not easily foldable, such as cash. In addition, prior art origami envelopes are typically folded using square-sized paper (i.e. where the width and the length of the paper are substantially equal) which is typically less readily available than other sizes of paper. In addition, some prior art origami envelopes may be constructed from folding irregular shaped sheets of paper (e.g., with protruding sections and cut-outs). In such cases, an operator must first manually trace and then cut out the sheet of paper in accordance with a template prior to folding. This can be very time-consuming.

There is a general desire for apparatus and methods that address at least some of the aforementioned problems.

The foregoing examples of the related art and limitations related thereto are intended to be illustrative and not exclusive. Other limitations of the related art will become apparent to those of skill in the art upon a reading of the specification and a study of the drawings.

SUMMARY

One aspect relates to a method of forming an origami envelope. Another aspect relates to an origami envelope formed by such method. The origami envelope is folded using a sheet of material. The sheet of material has a top right corner, a top left corner, a bottom right corner, and a bottom left corner, a top edge extending between the top right corner and the top left corner, a bottom edge opposite of the top edge, extending between the bottom right corner and the bottom left corner, and a first and second side extending between the top and bottom edges, the first side extending between the top left corner and the bottom left corner, and the second side opposite of the first side, extending between the top right corner and the bottom right corner. The sheet of material is first oriented such that the top and bottom edges extend width wise, and the first and second sides extend length wise. The sheet of material is folded to create at least five fold lines. The at least five fold lines comprises: a first fold line extending diagonally between a first midpoint positioned at one of the first and second sides and a first point positioned at one of the top and bottom edges, a second fold line extending diagonally between the first midpoint and a second point positioned at the edge that is opposite of the edge having the first point, a third fold line extending diagonally between a second midpoint and a third point positioned adjacent to one of the first and second points, a fourth fold line extending diagonally between one of the top corners and a fourth point positioned adjacent to the second midpoint, and a fifth fold line extending diagonally between the first or second point that is positioned at the top edge and a fifth point positioned adjacent to the second midpoint, wherein the second midpoint is positioned between the fifth point and the fourth point.

In some embodiments, the method of forming the origami envelope comprises at least five steps. The at least five steps comprises: a first step of folding the sheet of material along the first fold line to create a first substantially triangular structure, a second step of folding the sheet of material along the second fold line to create a second substantially triangular structure, a third step of folding the sheet of material along the third fold line to create a quadrilateral structure, a fourth step of folding the sheet of material along the fourth fold line to create a top and a bottom layer and a third substantially triangular structure extending from the top layer, and a fifth step of folding the sheet of material along the fifth fold line to extend the third substantially triangular structure from the top layer over to the bottom layer.

In some embodiments, the method of forming the origami envelope further comprises folding the sheet width wise to create an optional crease line extending between the first and second midpoints.

Another aspect relates to an origami envelope constructed from a sheet of material having a top edge extending between a top left corner and a top right corner, a bottom edge opposite of the top edge, extending between a bottom left corner and a bottom right corner, a first side extending between the top left corner and the bottom left corner, and a second side opposite of the first side, extending between the top right corner and the bottom right corner. The origami envelope comprises: a top envelope side and a bottom envelope side opposite to the top envelope side, a left envelope side and a right envelope side opposite to the left envelope side, a top layer having a front surface and a back surface opposite to the front surface, and a bottom layer having an exterior side and an interior side opposite to the exterior side, wherein the back surface of the top layer is in contact with the interior side of the bottom layer, and wherein the top layer extends to the exterior side of the bottom layer over a portion of the top envelope side and wherein the exterior side of the bottom layer comprises a closure flap.

In some embodiments, the origami envelope is constructed from a sheet of material having at least five fold lines. The at least five fold lines comprises: a first fold line extending diagonally between a first side point positioned at one of the first and second sides and a first edge point positioned at one of the top and bottom edges; a second fold line extending diagonally between a second side point positioned adjacent the first side point and a second edge point positioned at the edge opposite to the edge having the first edge point; a third fold line extending diagonally between a first endpoint positioned adjacent to the second edge point and a third side point positioned at the side opposite to the first and second side points; a fourth fold line extending diagonally between a second endpoint and a third endpoint, wherein an orthogonal projection of the second endpoint onto the first fold line is located between the first edge point and the first side point and the orthogonal projection of the third endpoint onto third fold line is located between the first endpoint and the third side point; and a fifth fold line extending diagonally between a fifth edge point positioned adjacent to the first edge point and a sixth side point positioned at the same side as one of the top or bottom corners.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
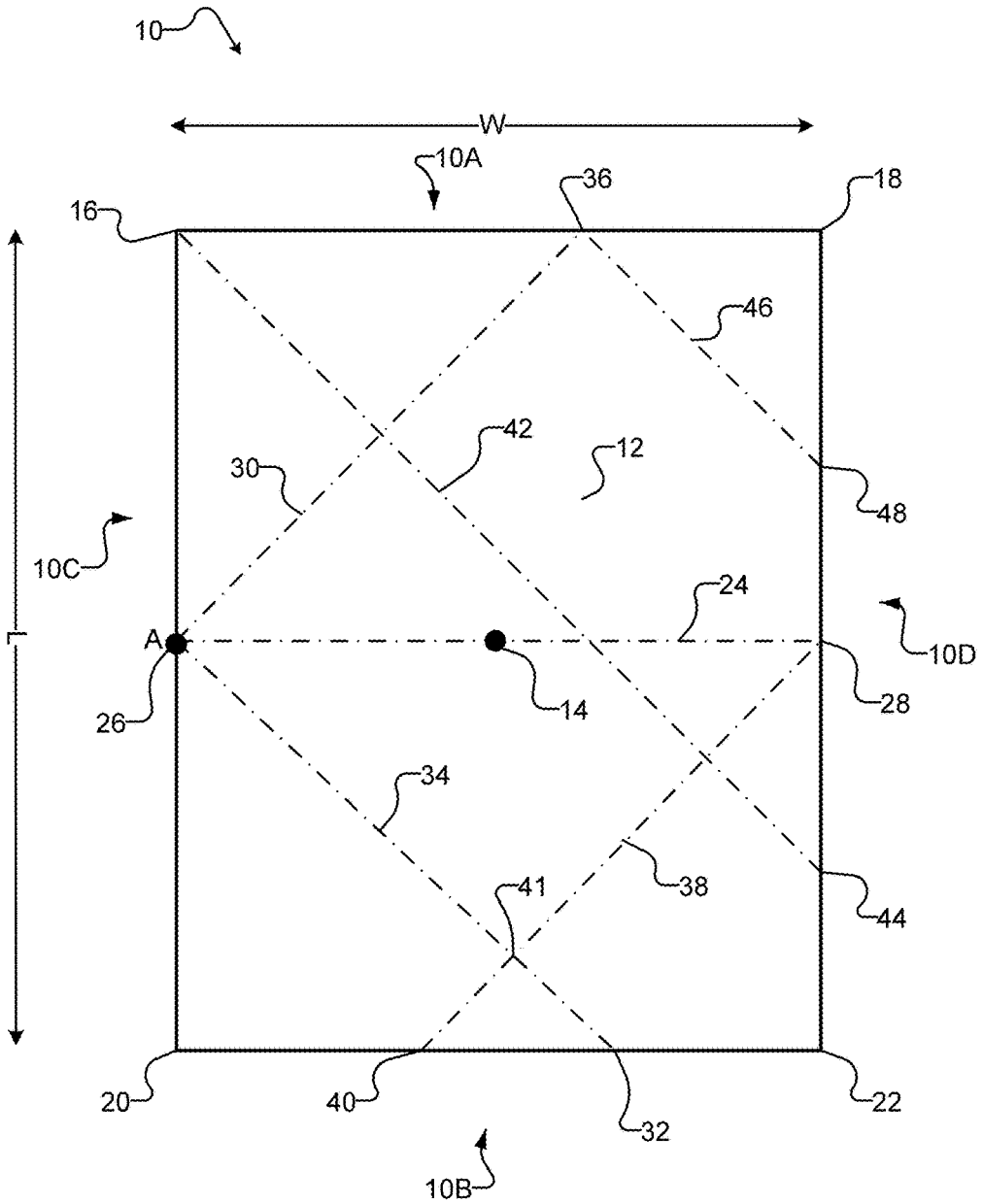
FIG. 1 is a top view of an unfolded configuration of an origami envelope showing the fold lines in accordance with an embodiment of the invention.

FIG. 1 illustrates an unfolded sheet 10 which may be folded into an origami envelope 11 according to a particular embodiment. Any suitable type of paper or any foldable materials such as plastic, foil, fabric, cardboard, cloth, napkin, and the like may be used as sheet 10.

Sheet 10 has a rectangular shape defined by a set of top corners 16, 18, and a set of bottom corners 20, 22 positioned opposite of their respective top corners 16, 18. In the illustrated embodiment, sheet 10 may comprise a width W which is shorter than a length L. Width W is defined as a top edge 10A or a bottom edge 10B. Top edge 10A extends between top corners 16, 18. Bottom edge 10B, positioned opposite of top edge 10A, extends between bottom corners 20, 22.

Length L is defined as a first side 10C or a second side 10D. First side 10C extends between top corner 16 and bottom corner 20. Second side 10D, positioned opposite of first side 10C, extends between top corner 18 and bottom corner 22.

In some embodiments, sheet 10 may have dimensions of a standard letter-size paper (i.e., 8½ by 11 inches, or 216 mm by 279 mm). In some embodiments, sheet 10 may have dimensions of a A4-sized paper (i.e. 8½ by 14 inches, or 210 mm by 297 mm). However, sheet 10 may have different dimensions in other embodiments. For example, sheet 10 may comprise a square or near-square shape, wherein a length is equal to or approximately equal to a width.

In the illustrated embodiment, sheet 10 has six fold lines 24, 30, 34, 38, 42, and 46 to make the origami envelope. An optional crease line 24 intersecting a center point 14 of sheet 10, extends substantially horizontally from a midpoint between top left corner 16 and its respective bottom left corner 20 (i.e. a first midpoint 26) to a midpoint between top right corner 18 and its respective bottom right corner 22 (i.e. a second midpoint 28), such that optional crease line 24 extends substantially parallel to the width W of sheet 10.

A first fold line 30 extends diagonally from the first midpoint 26 to a point positioned off-centered from the center point 14 along top edge 10A (i.e. a top point 36). In the illustrated embodiment, top point 36 is located more proximate to second side 10D than first side 10C. Top point 36 is located at approximately ⅔ of the width W of sheet 10 from first side 10C and approximately ⅓ of the width W of sheet 10 from second side 10D.

A second fold line 34 extends diagonally from the first midpoint 26 to a point positioned along bottom edge 10B opposite of the top point 36 (i.e. a first bottom point 32). Thus, similar to top point 36, first bottom point 32 is located approximately ⅔ of the width W of sheet 10 from first side 10C and approximately ⅓ of the width W of sheet 10 from second side 10D. Additionally, second fold line 34 and first fold line 30 are mirror images of each other having an axis of symmetry which extends along optional crease line 24.

A third fold line 38 extends diagonally from the second midpoint 28 to a point positioned off-centered from the center point 14 along bottom edge 10B, adjacent to the first bottom point 32, and is located more proximate to the first side 10C than the second side 10D (i.e. a second bottom point 40). In some embodiments, second bottom point 40 is located at approximately ⅓ of the width W of sheet 10 from first side 10C and approximately ⅔ of the width W of sheet 10 from second side 10D. Additionally, third fold line 38 is positioned substantially parallel to the first fold line 30 and perpendicular to second fold line 34.

A fourth fold line 42 extends from top corner 16 to a point off-centered from center point 14 along second side 10D, and which such point is located more proximate to the bottom edge 10B than the top edge 10A (i.e. a first right point 44). First right point 44 is located at approximately 0.77 of the length L of sheet 10 extending from top edge 10A, and approximately 0.23 of the length L of sheet 10 extending from bottom edge 10B. Additionally, fourth fold line 42 is positioned substantially parallel to third fold line 34 and perpendicular to first fold line 30 and third fold line 38.

A fifth fold line 46 extends from top point 36 to a point off-centered from the center point 14 along the second side 10D, located adjacent to first right point 44 but more proximate to the top edge 10A than the bottom edge 10B (i.e. a second right point 48). Second right point 48 is located at approximately 0.27 of the length L of sheet 10 from top edge 10A, and approximately 0.73 of the length L of sheet 10 from bottom edge 10B. Additionally, fifth fold line 46 is positioned substantially parallel to second fold line 34 and fourth fold line 42 and perpendicular to first fold line 30 and third fold line 38.

In some embodiments, sheet 10 includes only five fold lines 30, 34, 38, 42, and 46. In other words, optional crease line 24 is optional. Optional crease line 24 may merely be a pre-crease fold line. The pre-crease fold line is not required for the folding on the final product, but may be beneficial for aligning the other folds.

Figure 8:
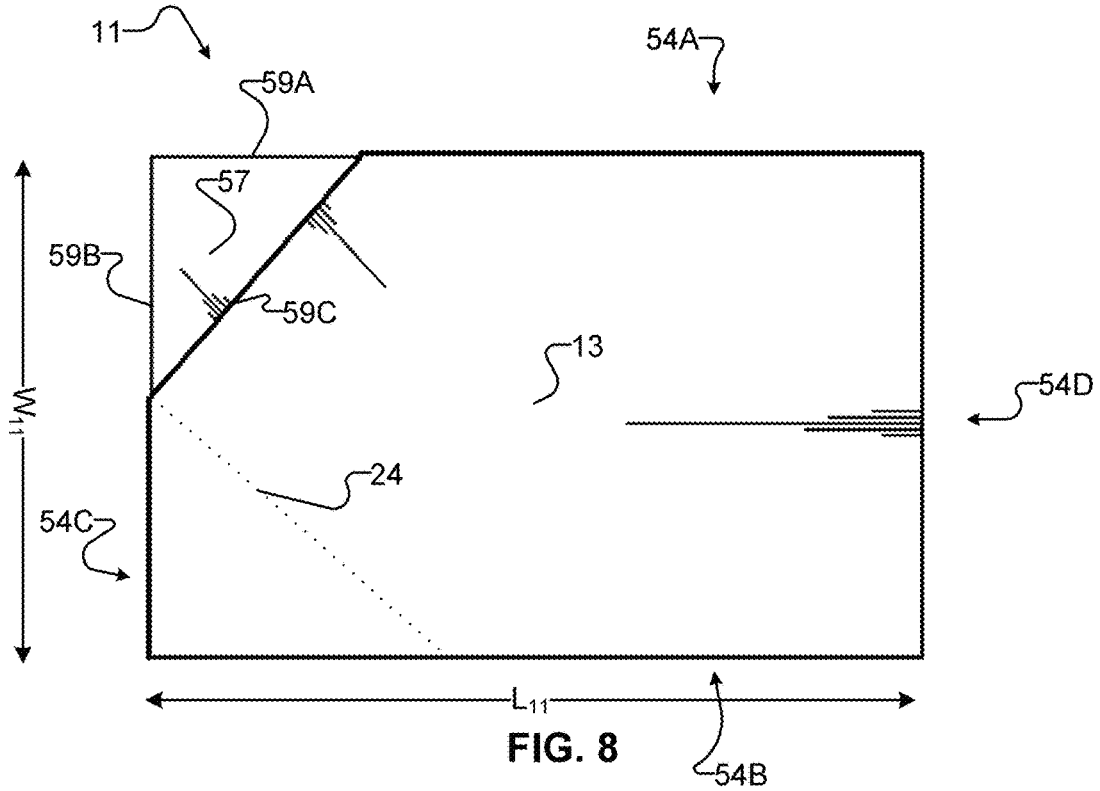
FIG. 8 is a top front view of a folded configuration of an origami envelope in accordance with an embodiment of the invention.

In FIG. 1, sheet 10 is shown with an inside surface 12 of sheet 10 facing up. Outer surface 13 (not seen in FIG. 1 but shown in FIGS. 8 and 9) is on the opposite side of sheet 10 and is facing down. Inside surface 12 of sheet 10 is not visible when envelope 11 is in its folded configuration. In some embodiments, messages may be written or printed directly on inside surface 12 so that addresses and stamps may be placed on an outer surface 13 when envelope 11 is in its folded configuration as shown in FIG. 8. In some embodiments, a separate piece of paper containing the message may be inserted into envelope 11 so that envelope 11 may be used as a folder or compartment. In some embodiments, objects such as greeting cards, gift cards, business cards and the like may be inserted into envelope 11. In some embodiments, envelope 11 may comprise both a printed message written on inside surface 12 and a separate message and/or object inserted into envelope 11.

The size of sheet 10 determines the size of the folded configuration of origami envelope 11. The object that could fit into origami envelope 11 would thus depend on the size of sheet 10. For example, if one wishes to insert a standard gift card (i.e. having dimensions of about 3⅜ by 2⅛ inches, or 85.725 mm by 53.975 mm) into origami envelope 11, sheet 10 having dimensions of approximately 6½ by 5 inches (165.1 mm by 127 m may be used. Accordingly, the size of sheet 10 may be customized to accommodate the different sizes of objects that are to be inserted into envelope 11.

Figure 2:
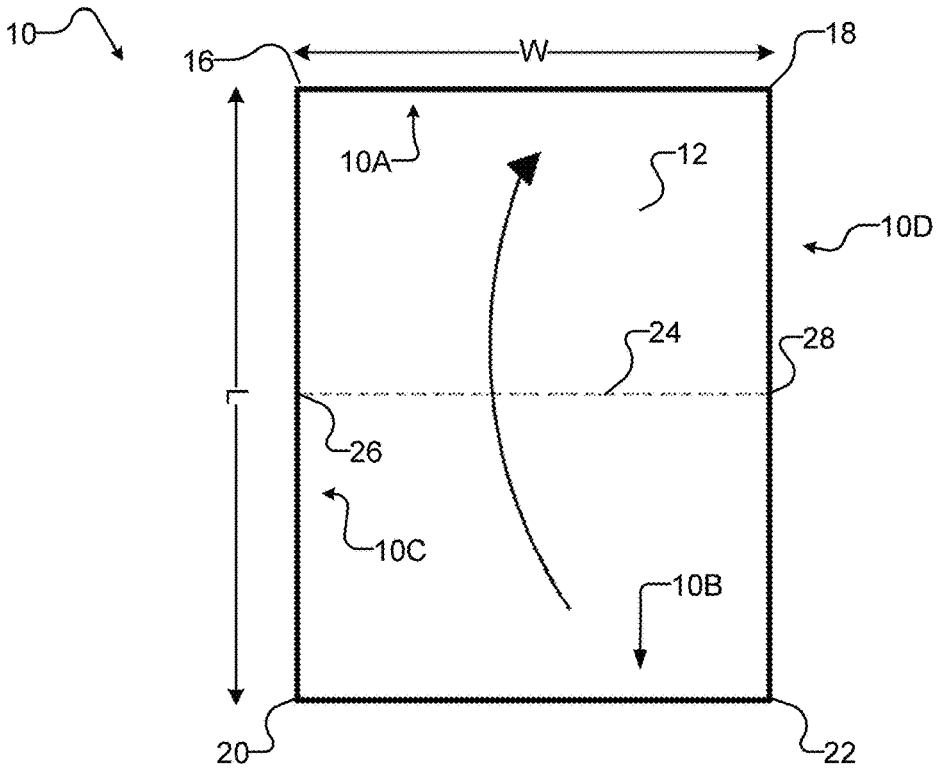
FIG. 2 illustrates an optional step in construction of an origami envelope in accordance with an embodiment of the invention.

FIGS. 2 to 9 illustrate the steps in making origami envelope 11. Origami envelope 11 may be constructed by five or six folding actions. To construct origami envelope 11, sheet 10 must first be oriented such that the top 10A and bottom 10B edges extend along the width W of the sheet 10, and the first 10C and second 10D sides extend along the length L of the sheet 10. FIG. 2 illustrates an optional step. The optional step is a pre-crease operation (i.e. fold, crease, and unfold) to generate optional crease line 24, which optional crease line 24 extends substantially parallel to the width W of sheet 10. This is done by folding sheet 10 in half width wise, such that top corners 16 and 18 are substantially aligned with their respective bottom corners 20 and 22. Folding sheet 10 is creased, and then unfolded.

Figure 3:
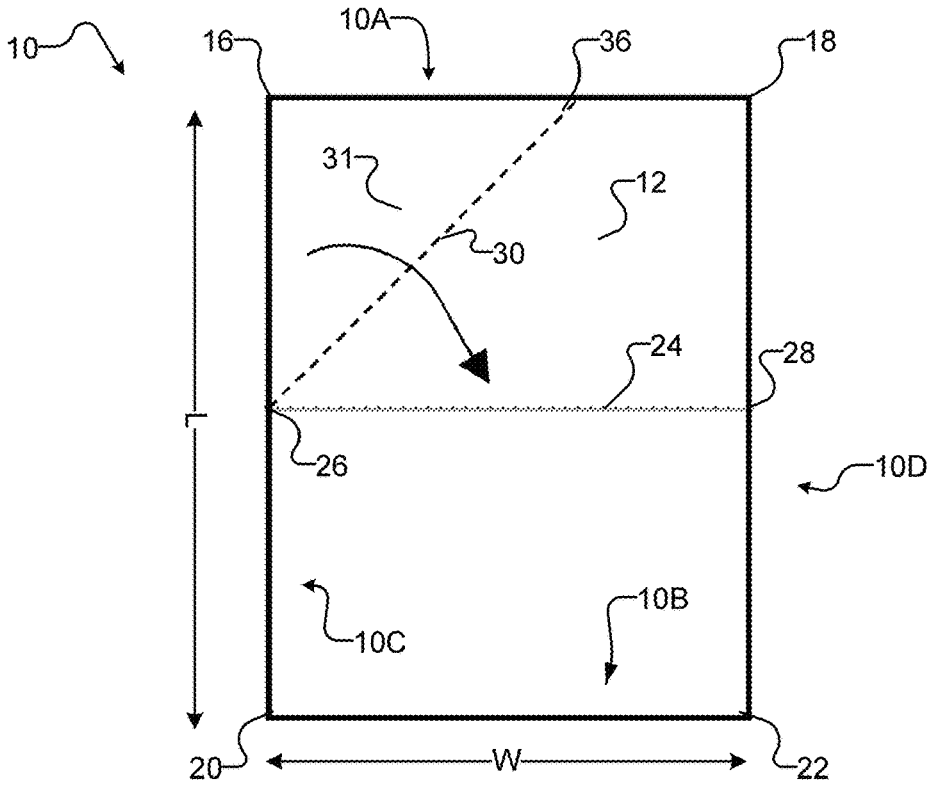
FIG. 3 illustrates a first step in construction of an origami envelope in accordance with an embodiment of the invention.
Figure 4:
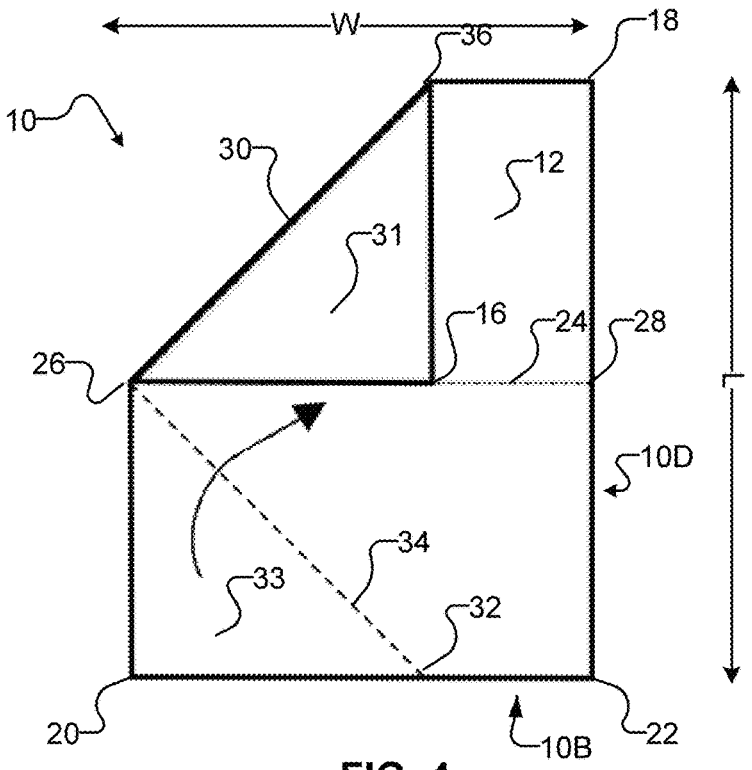
FIG. 4 illustrates a second step in construction of an origami envelope in accordance with an embodiment of the invention.

Referring to FIG. 3, a first step in the construction of origami envelope 11 is shown. In this step, a first corner is folded down diagonally along first fold line 30 to meet optional crease line 24. This creates a first triangle 31 (as best seen in FIG. 4). In the illustrated embodiment, top left corner 16 is folded down to form first triangle 31. Thus, first triangle 31 is folded from a portion of first side 10C of sheet 10. This is not mandatory, however. In some embodiments, the first triangle 31 may be folded from a portion of second side 10D. In such embodiment, first fold line 30 may be created by folding down top right corner 18 to meet optional crease line 24.

FIG. 4 illustrates a second step in the construction of origami envelope 11. In this step, a second triangle 33 is created by folding a second corner diagonally to meet optional crease line 24. In the illustrated embodiment, the second triangle 33 is created by folding up bottom left corner 20 diagonally along second fold line 34 to meet optional crease line 24 so that bottom left corner 20 is positioned adjacent to top left corner 16. Second triangle 33 and first triangle 31 are mirror images of each other having an axis of symmetry extending along optional crease line 24. In such embodiment, the two triangles are formed by folding the respective top and bottom corners that are positioned at the same side of sheet 10 in steps 2 and 3 (i.e. folding top left corner 16 and bottom left corner 20 or folding top right corner 18 and bottom right corner 22). In some embodiments, second fold line 34 may be positioned on the right side of sheet 10. In such embodiment, second fold line 34 may be created by folding up bottom right corner 22 to meet optional crease line 24.

In some embodiments, folding along second fold line 34 can occur before folding along first fold line 30. In other words, step 2 as illustrated in FIG. 4 may occur before step 1 as illustrated in FIG. 3.

In alternate embodiments, first 31 and second 33 triangles are not mirror images of each other as illustrated. In such embodiments, first 31 and second 33 triangles are formed by folding top and bottom corners that are positioned at opposite sides of sheet 10 (i.e. folding top left corner 16 and bottom right corner 22 or folding top right corner 18 and bottom left corner 20 in steps 1 and 2).

Figure 5:
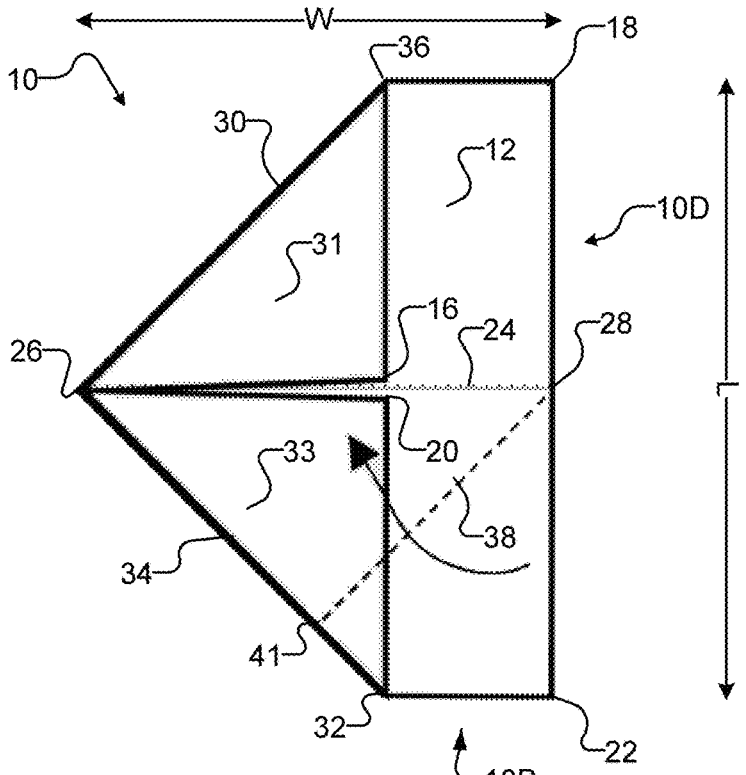
FIG. 5 illustrates a third step in construction of an origami envelope in accordance with an embodiment of the invention.
Figure 6:
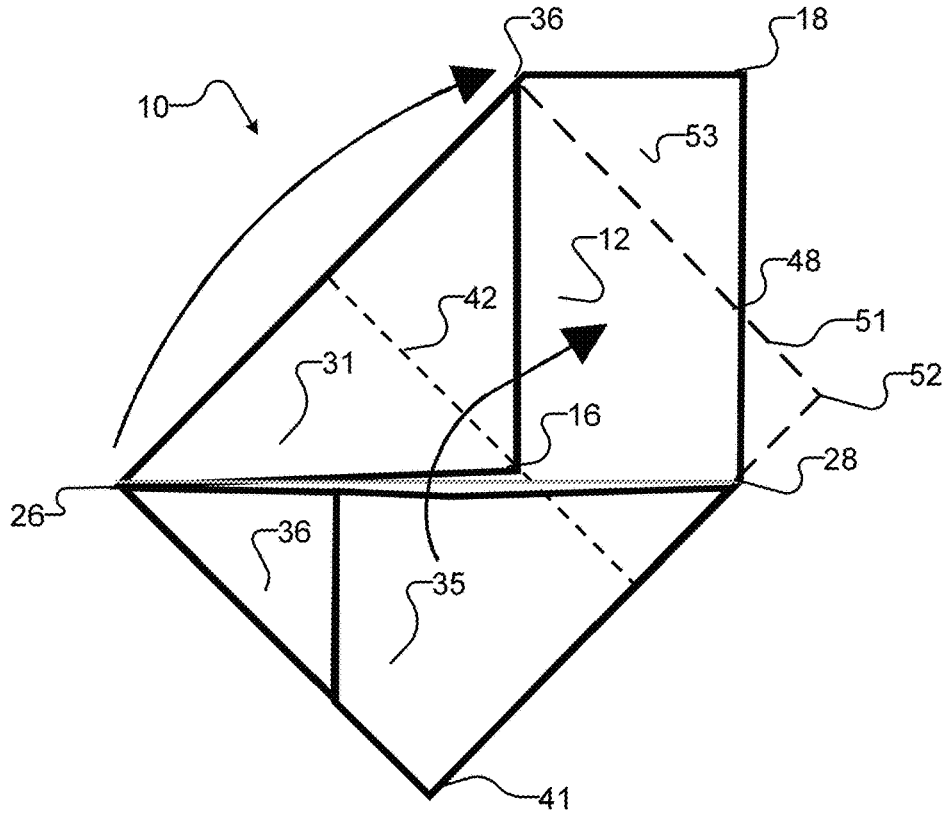
FIG. 6 illustrates a fourth step in construction of an origami envelope in accordance with an embodiment of the invention.

FIG. 5 illustrates a third step in the construction of origami envelope 11. In this step, a third corner is folded up or down to meet optional crease line 24 to form a quadrilateral 35 and triangular layer 36. In the illustrated embodiment, bottom right corner 22 is folded up diagonally along third fold line 38 subsequent to folding top left corner 16 down diagonally along first fold line 30 and bottom left corner 20 up diagonally along second fold line 34 to meet optional crease line 24 in steps 1 and 2. Following these particular folds, triangular layer 36 is positioned having a corner at first midpoint 26 (as best seen in FIG. 6). However, any third corner may be folded up or down. For example, for the configuration of FIG. 5, top right corner 18 may alternatively be folded down to meet optional crease line 24. The third corner may be any corner which has not been folded down or up to meet optional crease line 24 in the previous steps; as such, the third corner may be any of top corners 16 and 18, or bottom corners 20 and 22. The position of triangular layer 36 changes depending on which of the three corners of sheet 10 are folded in steps 1 to 3. For example, for the embodiment which top left corner 16 and bottom right corner 22 of sheet 10 are folded down and up along first fold line 30 and third fold line 38 respectively to meet optional crease line 24 in steps 1 and 2 (in any order) and bottom left corner 20 is folded up along second fold line 34 to meet optional crease line 24 in step 3, triangular layer 36 is positioned having a corner at second midpoint 28.

Figure 9:
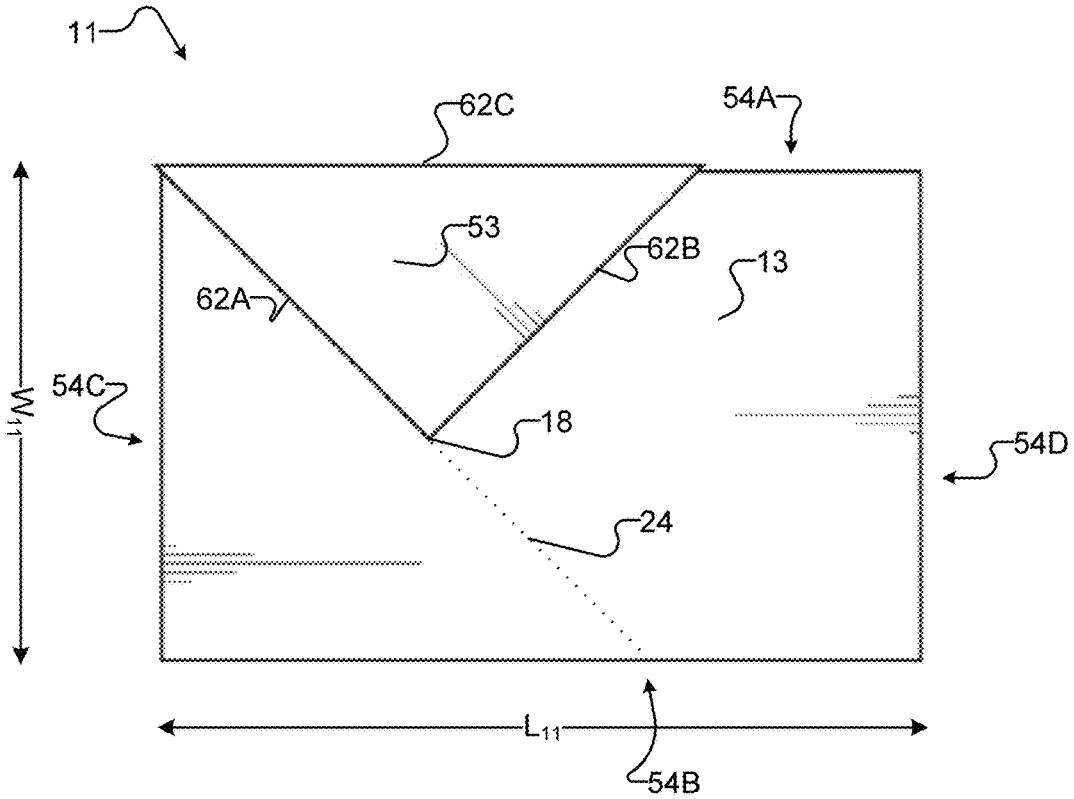
FIG. 9 is a top back view of a folded configuration of an origami envelope in accordance with an embodiment of the invention.

FIG. 6 illustrates a fourth step in the construction of origami envelope 11. In step 4, the bottom of the folded product formed by second fold line 34 is folded up to meet line 51 by folding along fourth fold line 42. In other words, first midpoint 26 and fold point 41 is folded up to meet left top point 36 and point 52, respectively. This fourth folding action produces a top and bottom layer of envelope 11, and a substantially triangular structure referred to as a closure flap 53. Top layer of envelope 11 includes a front surface (as seen in FIG. 8 which shows the front view of envelope 11) and a back surface opposite of the front surface (not shown). Bottom layer of envelope 11 includes an exterior side (as seen in FIG. 9 which shows the back view of envelope 11) and an interior side opposite of the exterior side (not shown). The back surface of the top layer is in contact with the interior side of the bottom layer when the top and bottom layers of envelope 11 are formed in the fourth step.

Figure 7:
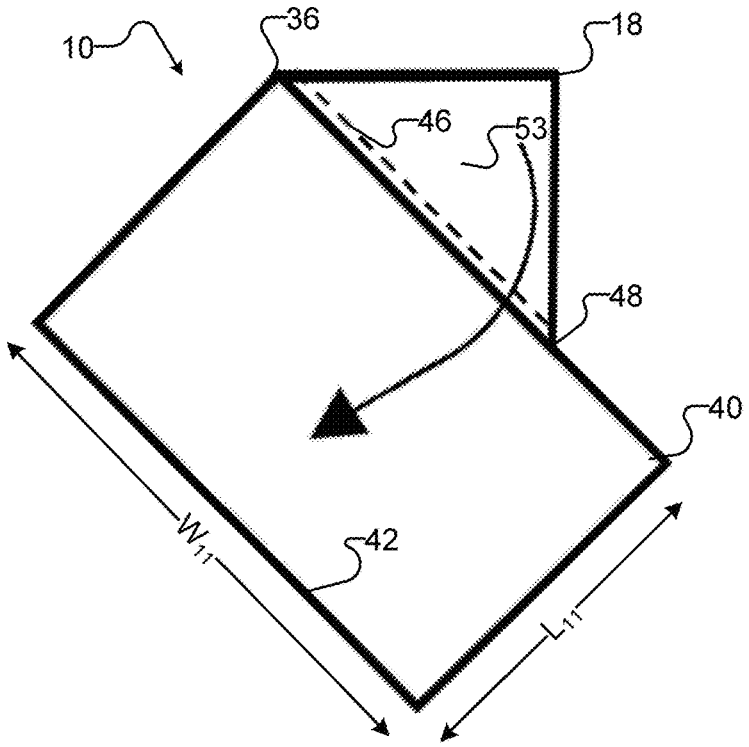
FIG. 7 illustrates a fifth step in construction of an origami envelope in accordance with an embodiment of the invention.

FIG. 7 illustrates a fifth step in the construction of origami envelope 11. Step 5 involves folding closure flap 53 down along sixth fold line 46 to produce a finished origami envelope 11, which is illustrated in FIG. 8 (showing a front view of origami envelope 11) and FIG. 9 (showing a back view of origami envelope 11). Fifth fold line 46 substantially aligns with line 51. Closure flap 53 may be optionally sealed to secure the contents in origami envelope 11 using adhesive tape, glue, staples, a sticker and the like.

Referring to FIG. 8 which shows the front view of origami envelope 11, origami envelope 11 comprises a top envelope side 54A, a bottom envelope side 54B, a left envelope side 54C and a right envelope side 54D. In the illustrated embodiment, the side which extends along the top envelope side 54A and the bottom envelope side 54B is length $L_{11}$, and the side which extends along the left envelope side 54C and the right envelope side 54D is width $W_{11}$. Length $L_{11}$ is greater than a width $W_{11}$. In some embodiments, width $W_{11}$ is approximately ⅔ of length $L_{11}$.

In the illustrated embodiment, origami envelope 11 comprises a triangle 57 positioned at a top left corner of origami envelope 11. Triangle 57 comprises two substantially equal length sides 59A and 59B perpendicularly positioned to form a right angle, and a side 59C having a length longer than 59A and 59B, positioned opposite of the right angle. In some embodiments, side 59A may extend along a portion of top envelope side 54A, and side 59B may extend along a portion of left envelope side 54C. In alternative embodiments, side 59A may extend along a portion of top envelope side 54A, and side 59B may extend along a portion of right envelope side 54D.

In some embodiments, side 59C of origami envelope 11 may be constructed from a portion of length L of sheet 10. Side 59C of envelope 11 may be constructed from the portion of second side 10D which extends between second midpoint 28 and second right point 48.

In some embodiments, triangle 57 is created by extending the top layer of envelope 11 to the bottom layer over a portion of the top envelope side 54A. In some embodiments, a ratio between the portion of the top envelope side and the top envelope side ranges from approximately 0.05 to approximately 1.00. In some embodiments, a ratio between the portion of the top envelope side and the top envelope side is approximately 0.65 to 0.75. In such embodiments, a ratio between side 59A of triangle 57 and the top envelope side 54A is thus between 0.25 to 0.35.

Referring to FIG. 9 which shows a back view of origami envelope 11, as discussed in relation to FIG. 7, origami envelope 11 comprises closure flap 53. Closure flap 53 comprises a triangle having two substantially equal length sides 62A and 62B perpendicularly disposed to form a right angle at top right corner 18, and a side 62C having a length longer than 62A and 62B positioned opposite of the right angle.

In some embodiments, side 62B of envelope 11 may be constructed from a portion of length L of sheet 10. Side 62B may be constructed from the portion of second side 10D which extends between second right point 48 and top right corner 18. In some embodiments, side 62A may be constructed from a portion of width W of sheet 10. Side 62A may be constructed from the portion of top edge 10A which extends between top right corner 18 and top point 36.

In some embodiments, sheet 10 is not pre-creased and one would be required to create fold lines 24, 30, 34, 38, 42, and 46 or fold lines 30, 34, 38, 42, and 46 manually to produce origami envelope 11. In some embodiments, sheet 10 may be pre-creased with folds lines 24, 30, 34, 38, 42, and 46 or fold lines 30, 34, 38, 42, and 46 by a machine.

In some embodiments, a printed message may first be written on inside surface 12 of sheet 10 prior to the construction of origami envelope 11 according to the five or six steps that are illustrated in FIGS. 2 to 9. First triangle 31, second triangle 33 and quadrilateral 35 are concealed within envelope 11 and thus referring to FIGS. 4 to 6, additional messages may be printed on first triangle 31, second triangle 33, and/or quadrilateral 35 in steps 2, 3, and 4 respectively.

In some embodiments, objects such as gift cards, cards, letters, and the like may be inserted into envelope 11 during which the envelope 11 is being constructed. For example, such objects may be inserted into envelope 11 between steps 3 and 4 (see FIGS. 5 and 6) when the compartment of envelope 11 has been constructed. The compartment of envelope 11 includes opposing edges 54A, 54B and opposing sides 54C, 54D (as shown in FIGS. 8 and 9).

The contents inside envelope 11 may be secured by attaching closure flap 53 onto envelope 11. Closure flap 53 is depicted in FIG. 9. Closure flap 53 may be attached to envelope 11 by using glue, tape, a sticker, staples and the like. In addition, the front of the envelope, as best seen in FIG. 8, can include the name and/or address of the recipient, as well as a mailing stamp.

To access the contents within origami envelope 11, a recipient can lift closure flap 53 (i.e. unfold fold line 46), and unfold each of fold lines 42, 34, 30 and 38 to return to the unfolded configuration, i.e. unfolded sheet 10 as shown in FIG. 1. In other words, one can reverse each of the folding steps 1-5 as illustrated in FIGS. 3-7 to unfold envelope 11.

Origami envelope 11 has many advantages over existing origami envelopes. Origami envelope 11 can be substituted for conventional envelopes. Unlike prior art origami envelopes which are often constructed using irregular shaped paper or the conventional square sized origami paper, origami envelope 11 can be constructed using paper sizes which are readily available, in particular, rectangular-dimensioned paper such as legal or A4-sized paper. In addition, origami envelope 11 can be easily constructed by as few as five folding actions, without using additional tools such as scissors.

Some aspects of the invention include origami envelopes constructed from unfolded sheet of materials having fold lines that differ in position as those depicted in FIG. 1. FIGS. 10-14 illustrate unfolded sheets 100A, 100B, 100C, 100D which may be folded into origami envelopes 111A, 111B, 111C, 111D respectively according to particular embodiments. In the drawings, letters are appended to the reference numerals in accordance with their embodiment (for example, the FIG. 10 embodiment shows 116A, 118A, etc.). However, for convenience, the features are also herein referred to by the reference numerals without letters appended to the reference numerals. FIGS. 10-14 show examples of the different fold lines that could be used to construct an origami envelope. In other embodiments, unfolded sheets with fold lines at different positions than as shown in FIGS. 10-14 may be used to construct an origami envelope.

Figure 15:
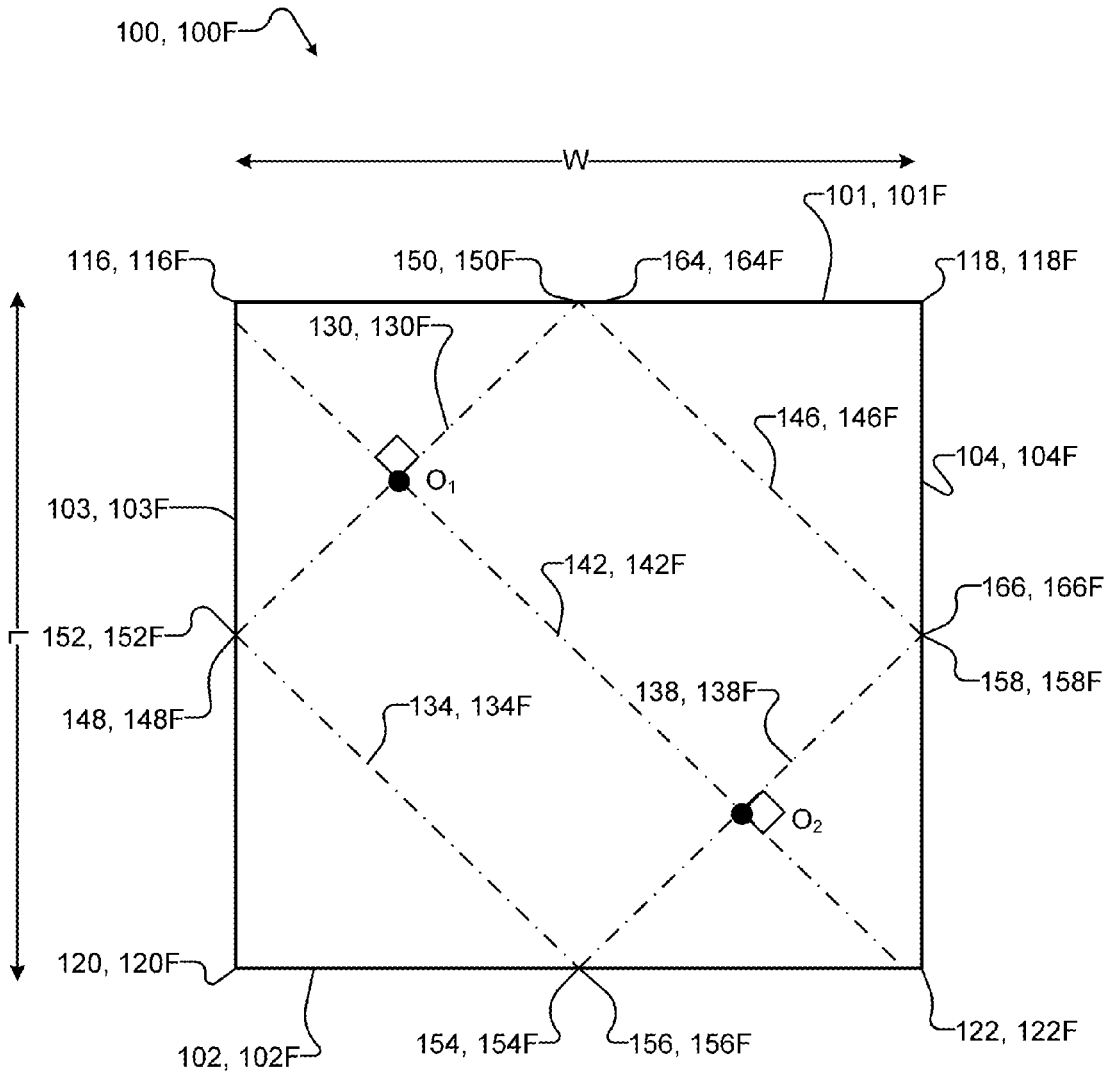
FIG. 15 is a top view of an unfolded configuration of an origami envelope showing the fold lines in accordance with an embodiment of the invention.

Each of sheets 100A, 100B, 100C, 100D has a rectangular shape. Sheets 100A, 100B, 100C and 100D may be referred to herein collectively and individually as sheet(s) 100. A sheet of material having a rectangular shape is not mandatory. The sheet of material may be any quadrilateral shape. In particular embodiments, the sheet of material may be a rectangle in the form of a square, as shown in FIG. 15. In the illustrated embodiments, the sheet of material comprises corners having right angles. In some embodiments, the sheet of material may comprise corners with non-right angles. The sheet of material may also comprise corners of other shapes, including for example, rounded corners.

Referring to FIGS. 10-14, sheet 100 is defined by a pair of top corners 116, 118 and a pair of bottom corners 120, 122 positioned opposite to top corners 116, 118. In the illustrated embodiments, sheet 100 has a width W which is shorter than a length L of sheet 100. Width W is defined as the distance between first and second sides 103, 104. First side 103 extends between top corner 116 and bottom corner 120. Second side 104 is positioned opposite to first side 103 and extends between top corner 118 and bottom corner 122. Length L is defined as the distance between top and bottom edges 101, 102. Top edge 101 extends between top corners 116, 118. Bottom edge 102 is positioned opposite to top edge 101 and extends between bottom corners 120, 122.

Figure 10:
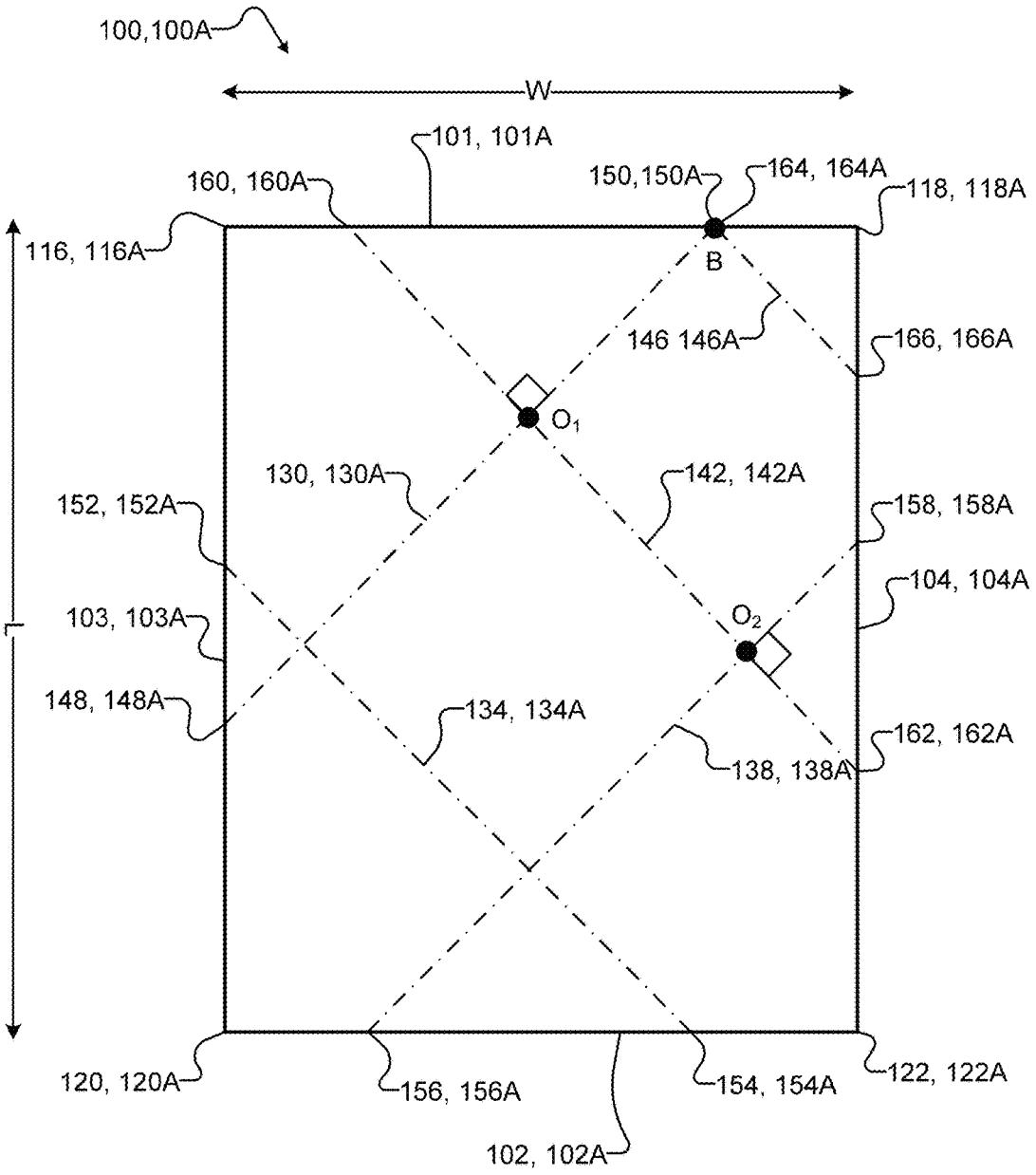
FIG. 10 is a top view of an unfolded configuration of an origami envelope showing the fold lines in accordance with an embodiment of the invention.
Figure 11:
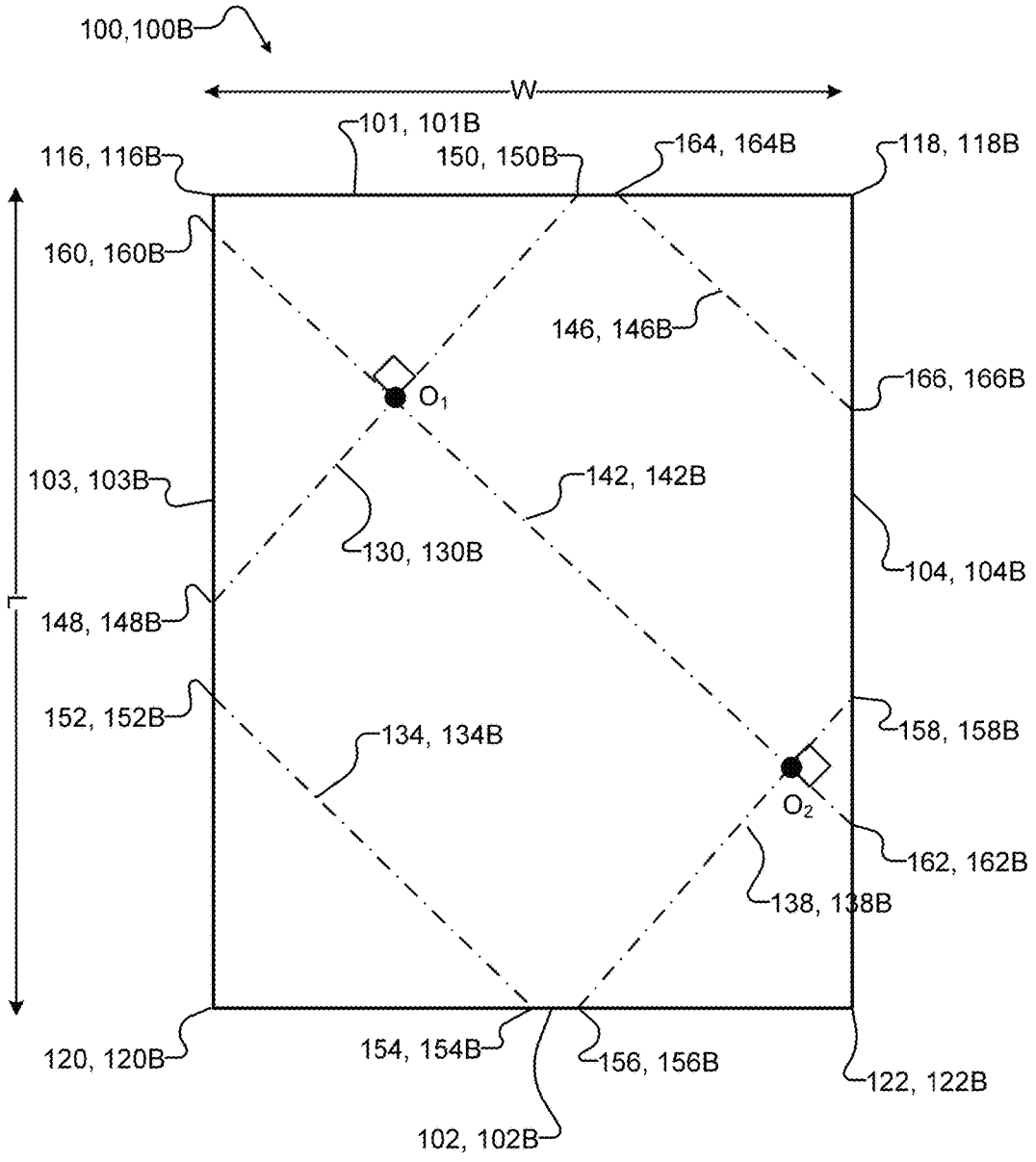
FIG. 11 is a top view of an unfolded configuration of an origami envelope showing the fold lines in accordance with an embodiment of the invention.
Figure 12:
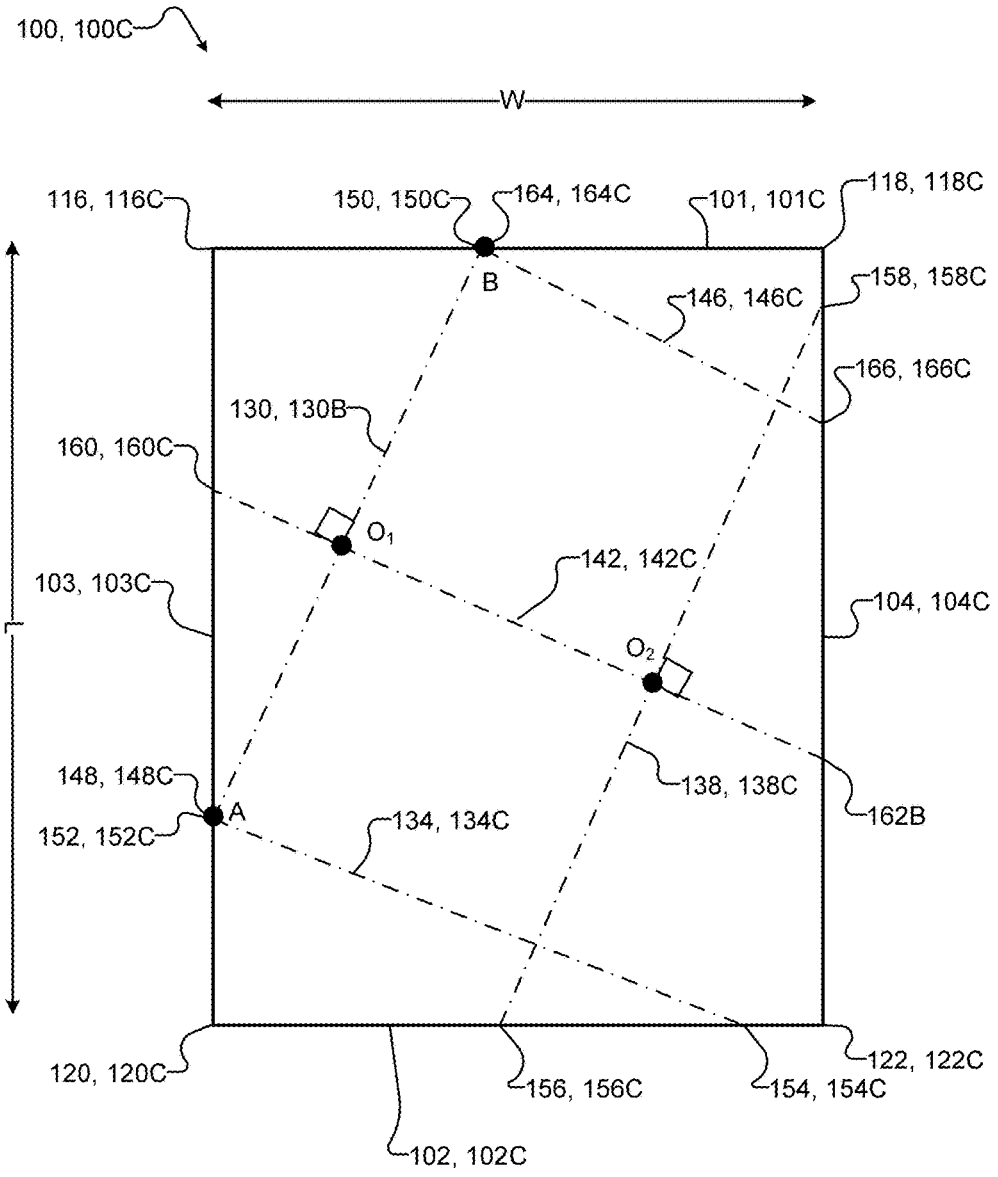
FIG. 12 is a top view of an unfolded configuration of an origami envelope showing the fold lines in accordance with an embodiment of the invention.
Figure 13:
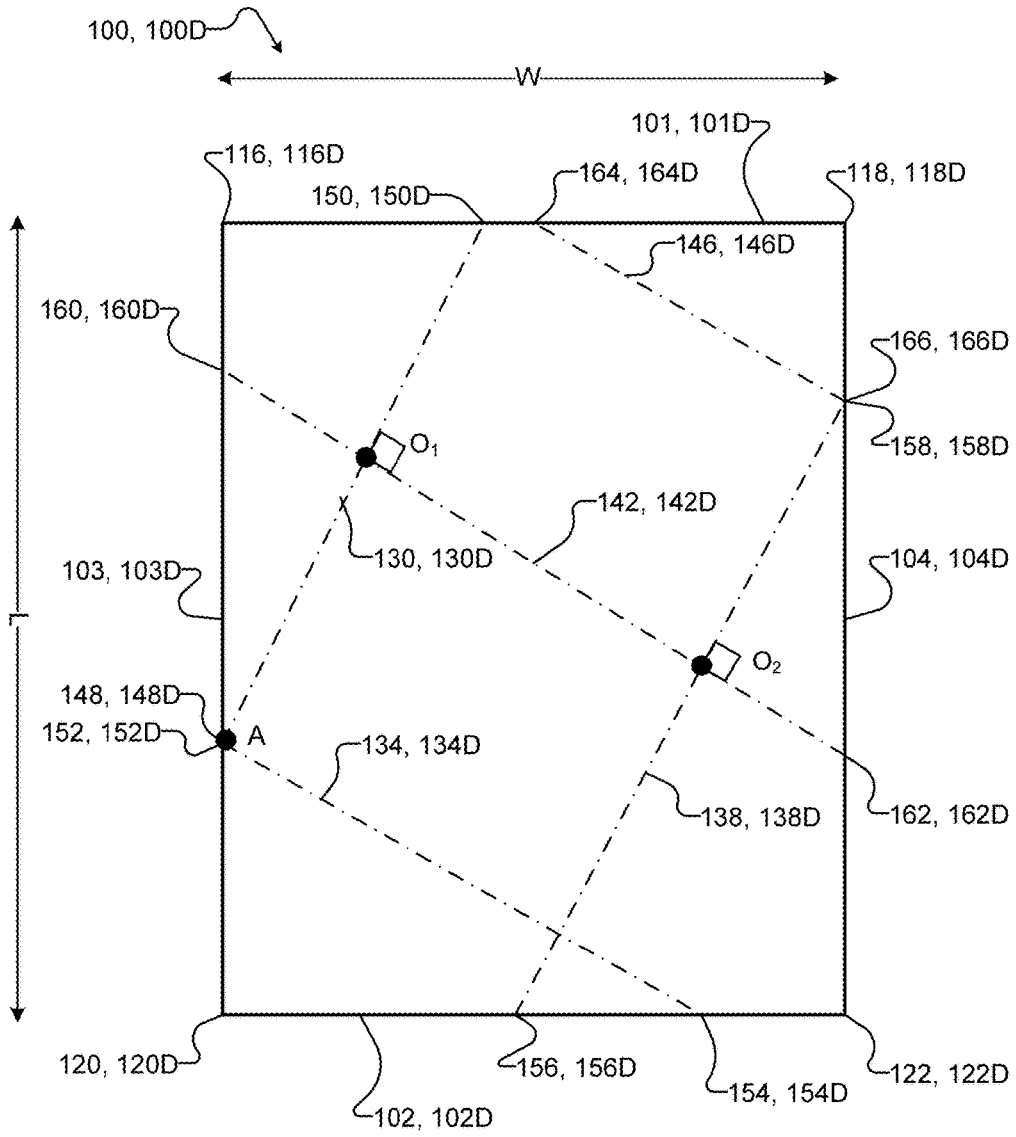
FIG. 13 is a top view of an unfolded configuration of an origami envelope showing the fold lines in accordance with an embodiment of the invention.
Figure 14:
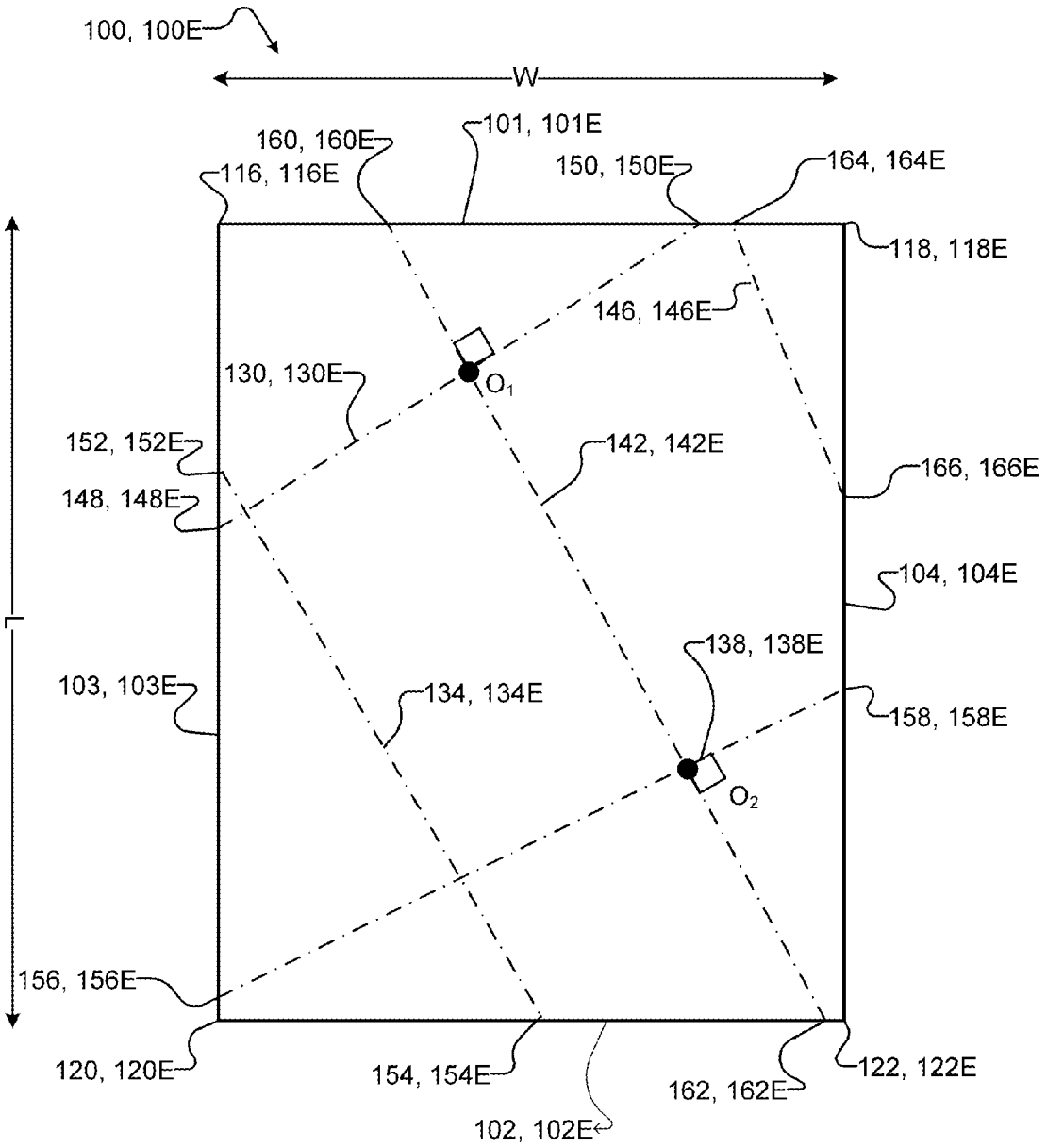
FIG. 14 is a top view of an unfolded configuration of an origami envelope showing the fold lines in accordance with an embodiment of the invention.

In particular embodiments, the origami envelope is constructed from a sheet of material having at least five fold lines. As illustrated in FIG. 10, sheet 100 comprises five fold lines 130, 134, 138, 142, and 146 to make the origami envelope. As shown in the illustrated embodiments, the fold lines define at least eight geometric regions on each of the sheets. The at least eight geometric regions may comprise a combination of quadrilateral-shaped and triangular-shaped regions.

In the illustrated embodiments, first fold line 130 extends diagonally between a first side point 148 positioned at first side 103 and a first edge point 150 positioned at top edge 101. First side point 148 and first edge point 150 may, however, alternatively be positioned at second side 104 and bottom edge 102 respectively.

Second fold line 134 extends diagonally between a second side point 152 positioned adjacent to first side point 148 and a second edge point 154 positioned at the bottom edge 102 opposite to first edge point 150. In some embodiments, the first side point 148 and second side point 152 are spaced apart from each other. This is best shown in the FIGS. 10 and 11 embodiments. In some embodiments, the distance between the first 148 and second 152 side points may be in the range of approximately 5% to 40% of length L. In some embodiments, the distance between first and second side points 148, 152 may be in the range of approximately 5% to 20% of length L. In some embodiments, the first side point 148 substantially coincides with second side point 152 to intersect at Point A. This is best illustrated in the FIGS. 12 and 13 embodiments. Point A may be positioned at any point along first side 103. In some embodiments, Point A is located at a midpoint along first side 103 (as shown in the FIG. 1 embodiment). In some embodiments, Point A is located along the side in the range of approximately ⅓ to ⅔ of the length of the sheet from one of the top 116, 118 or bottom 120, 122 corners to the other one of the top 116, 118 or bottom 120, 122 corners.

Third fold line 138 extends diagonally between a first endpoint 156 positioned adjacent to second edge point 154 and a third side point 158 positioned at the side opposite to the side containing first and second side points 148, 152. In some embodiments, first endpoint 156 may be located at the bottom edge 102 having second edge point 154 (as shown in the FIGS. 10 to 13 embodiments). In such embodiments, first endpoint 156 is positioned spaced-apart from second edge point 154 either leftward or rightward from second edge point 154. In some embodiments, the distance between first endpoint 156 and second edge point 154 may be in the range of approximately 2% to 60% of width W. In other embodiments, first endpoint 156 may be located at the side having the first and second side points 148, 152 (as shown in the FIG. 14 embodiment). In such embodiments, first endpoint 156 is proximate to a top corner 116, 118 or a bottom corner 120, 122. The distance between first endpoint 156 and the proximate corner may be in the range of approximately 1% to 40% of length L.

Fourth fold line 142 extends diagonally between a second endpoint 160 and a third endpoint 162. As seen in FIG. 10, the orthogonal projection $O_1$ of second endpoint 160 onto first fold line 130 is located between first edge point 150 and first side point 148. The orthogonal projection $O_2$ of third endpoint 162 onto third fold line 138 is located between third side point 158 and first endpoint 156. In some embodiments, second endpoint 160 is located at the edge having first edge point 150 and is adjacent to first edge point 150 (as shown in the FIGS. 10 and 14 embodiments). In such embodiments, second endpoint 160 may be located along top edge 101. In some embodiments, the distance between second endpoint 160 and first edge point 150 is in the range of approximately 30% to 80% of width W. In some embodiments, second endpoint 160 is located at the side having first and second side points 148,152 (as shown in the FIGS. 11, 12 and 13 embodiments). In such embodiments, second endpoint 160 may be located along first side 103. In some embodiments, the distance between second endpoint 160 and first side point 148 may be in the range of approximately 20% to 60% of length L. In some embodiments, the distance between second endpoint 160 and first side point 148 may be in the range of approximately 40% to 50% of length L. In some embodiments, third endpoint 162 is positioned at the edge having second edge point 154 and is adjacent to second edge point 154 (as shown in the FIG. 14 embodiment). In such embodiments, third endpoint 162 is located proximate to a bottom left corner 120 or a bottom right corner 122. The distance between third endpoint 162 and the bottom left corner 120 or bottom right corner 122 may be in the range of approximately 1% to 40% of width W. In some embodiments, third endpoint 162 is positioned at the side having third side point 158 and is adjacent to third side point 158 (as shown in the FIGS. 10 to 13 embodiments). In such embodiments, third endpoint 158 may be located at second side 166. In some embodiments, the distance between third endpoint 162 and third side point 158 is in the range of approximately 5% to 60% of length L.

Fifth fold line 146 extends diagonally between a fifth edge point 164 positioned adjacent to first edge point 150 and a sixth side point 166. In some embodiments, sixth side point 166 forms a triangle with fifth edge point 164 and top right corner 118. Sixth side point 166 may share a common side (first side 104) with a top or bottom corner 116, 118, 120, 122. In the illustrated embodiment, sixth side point 166 shares a common side with top right corner 118. In such embodiment, sixth side point 166 is positioned adjacent to top right corner 118. In some embodiments, fifth edge point 164 coincides substantially with first edge point 150 at point B (as shown in the FIGS. 10 and 12 embodiments). In particular embodiments, point B is located in the range of approximately 10% to 70% of the width W of sheet 100 from top left 116 corner or top right corner 118. In other embodiments, fifth edge point 164 is positioned spaced apart from first edge point 150 (as shown in the FIGS. 11, 13 and 14 embodiments). In such embodiments, the distance between fifth edge point 164 and first edge point 150 is in the range of approximately 5% to 30% of width W. In particular embodiments, sixth side point 166 is positioned in the range of approximately 10% to 40% of the length L of sheet 100 from top left corner 116 or top right corner 118.

In the illustrated embodiments, first and third fold lines 130, 138 are positioned spaced apart from each other and parallel to each other while second, fourth and fifth fold lines 134, 142, 148 are positioned spaced apart from each other and parallel to each other and perpendicular to each of first and third fold lines 130, 138. In some embodiments, fourth fold line 142 is positioned between second 134 and fifth fold line 146. In some embodiments, third fold line 138 intersects one or more of second, and/or fourth, and/or fifth fold lines 134, 142, 146. In some embodiments, fourth fold line 142 intersects one or both first and third fold lines 130, 138. In some embodiments, fourth fold line 142 intersects first fold line 130 at approximately a midpoint along a length of first fold line 130.

As mentioned above, in other embodiments, the origami envelope can be constructed from a sheet of material having a square or near-square shape, wherein its length is equal to or approximately equal to its width. An example of an unfolded sheet 100E having a square or near-square shape which may be folded into an origami envelope is shown in FIG. 15.

An origami envelope is constructed from any of the FIG. 10-15 sheet 100 having the at least five fold lines. The origami envelope is constructed from folding sheet 100 along each of the fold lines, similarly to the method of folding origami envelope 11 from sheet 10 shown in FIGS. 2 to 9. In particular embodiments, the origami envelope can be constructed by folding down along the at least five fold lines 130, 134, 138, 142, 146 in any sequence. For example, the origami envelope can be constructed from first folding along fourth fold line 142 before first fold line 130, second fold line 134 and third fold line 138. In some embodiments, the origami envelope is constructed by folding along first fold line 130, second fold line 134, third fold line 138 and fourth fold line 142 in any sequence but by folding along fifth fold line 146 last after the folding down of first, second, third and fourth fold lines 130, 134, 138, 142. In some embodiments, the origami envelope is constructed by folding along first fold line 130, second fold line 134 and third fold line 138 in any sequence but by folding along fourth fold line 142 and fifth fold line 146 in sequence after the folding down of first, second, and third fold lines 130, 134, 138.

In some embodiments, the folding down of each of first fold line 130, second fold line 134, third fold line 138 and fifth fold line 146 creates a triangle. In such embodiments, the triangles created by each of first fold line 130, second fold line 134, third fold line 138 and fifth fold line 146 are "similar" triangles. "Similar" triangles mean triangles that have the same shape, and two triangles are "similar" if they have two pairs of corresponding angles that are congruent. In some embodiments, each of these triangles is a right triangle.

Figure 16:
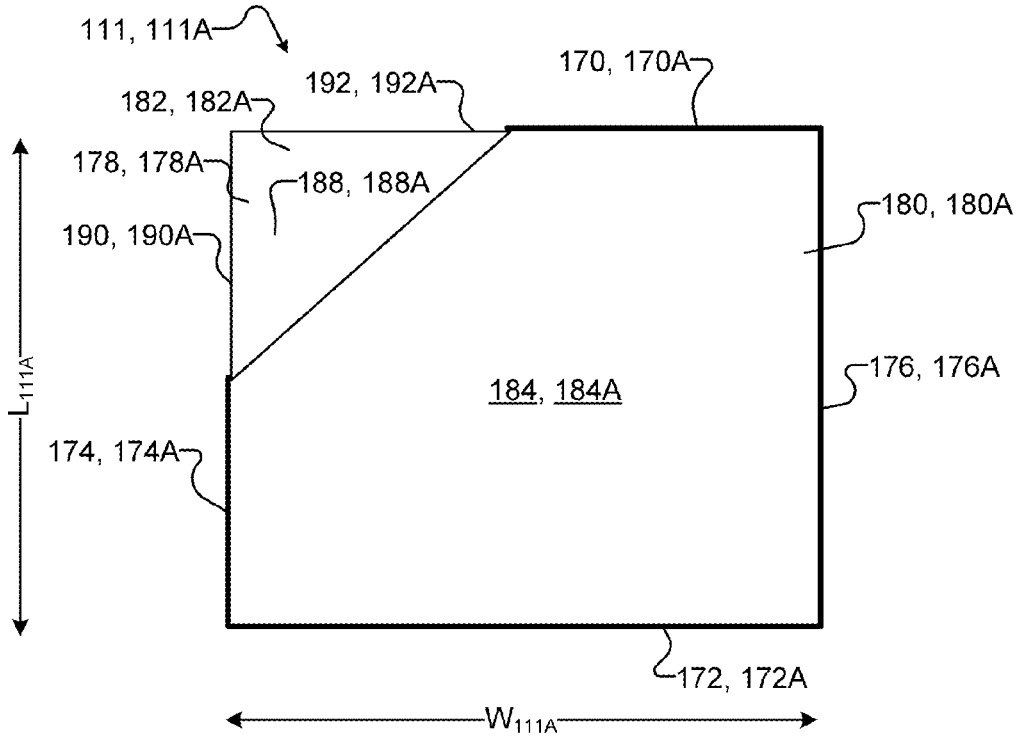
FIG. 16 is a top front view of a folded configuration of an origami envelope in accordance with an embodiment of the invention.
Figure 17:
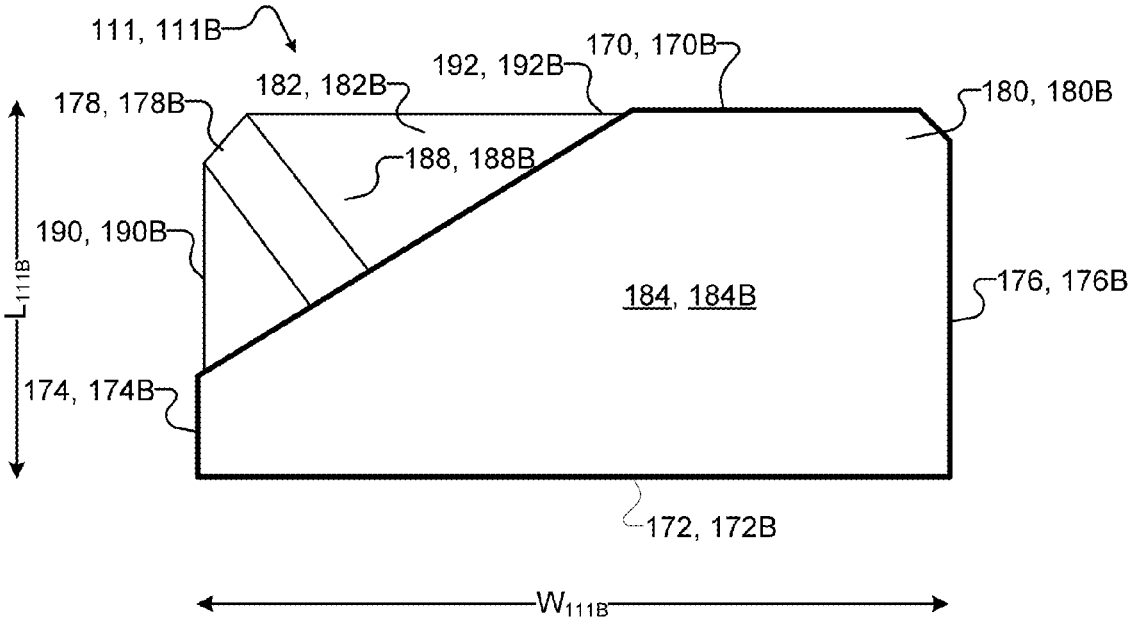
FIG. 17 is a top front view of a folded configuration of an origami envelope in accordance with an embodiment of the invention.
Figure 18:
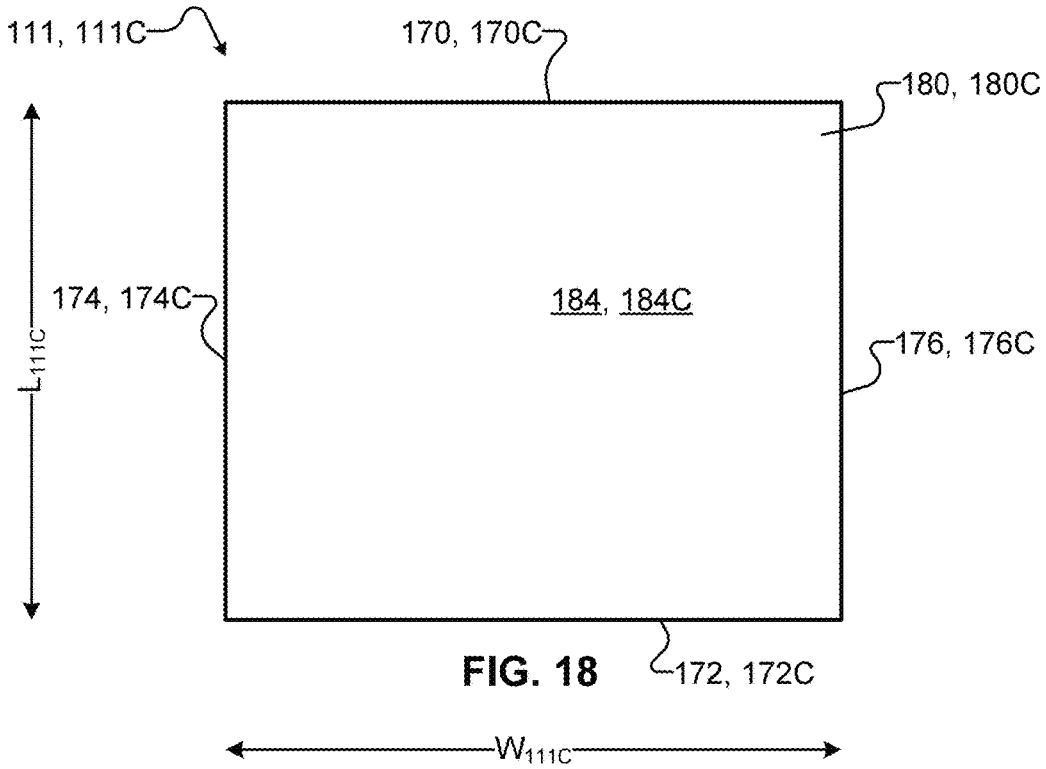
FIG. 18 is a top front view of a folded configuration of an origami envelope in accordance with an embodiment of the invention.
Figure 28:
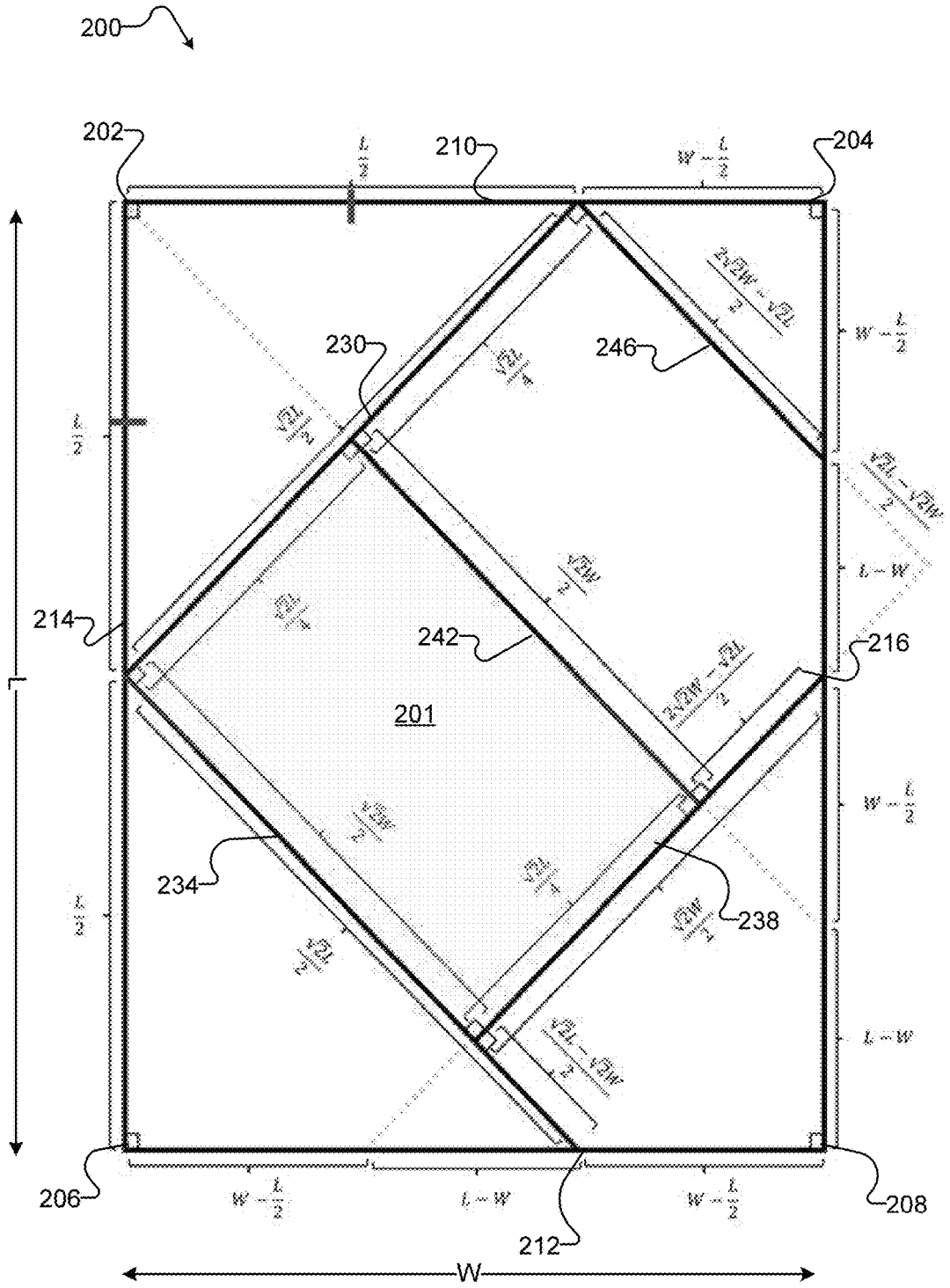
FIG. 28 is a schematic diagram showing a top view of an unfolded configuration of an origami envelope marked with precise measurements of each of the geometrical regions created by folding down each of the fold lines.

Referring to FIGS. 16 to 21 which show the front views of each of folded origami envelopes 111A, 111B, 111C, 111D, 111E and 111F (collectively and individually origami envelope 111) constructed from unfolded sheets 100A, 100B, 100C, 100D, 100E and 100F (collectively, unfolded sheet 100) respectively. In the drawings, letters are appended to the reference numerals in accordance with their embodiment (for example, the FIG. 16 embodiment shows 170A, 172A, etc.). However, for convenience, the features are also herein referred to by the reference numerals without letters appended to the reference numerals. Origami envelope 111 comprises a quadrilateral shape. In some embodiments, the quadrilateral shape of origami envelope 111 is a rectangle. Each origami envelope 111 comprises a top envelope side 170, a bottom envelope side 172, a left envelope side 174 and a right envelope side 176. The distance between top envelope side 170 and bottom envelope side 172 defines a width $W_{111}$ and the distance between left envelope side 174 and right envelope side 176 defines a width $L_{111}$. In some embodiments, length $L_{111}$ is greater than a width $W_{111}$ (as shown in FIGS. 17, 19, 20 and 21). In some embodiments, length $L_{111}$ is substantially equal to width $W_{111}$ (as shown in FIGS. 16 and 18). In particular embodiments, a surface area of the origami envelope comprises approximately one-quarter of a surface area of unfolded sheet 200. This is best illustrated in FIG. 28 wherein a surface area of the folded origami envelope is shown as a shaded portion 201 of the unfolded sheet 200. Referring to FIG. 28, the sheet of material 200 that is used to construct origami envelope comprises a top left corner 202, a top right corner 204, a bottom left corner 206 and a bottom right corner 208. A top side 210 is defined by the side extending between top left corner 202 and top right corner 204 while a bottom side 212 is defined by the side extending between bottom left corner 206 and bottom right corner 208. A left side 214 is defined by the side extending between top left corner 202 and bottom left corner 206 while a right side 216 is defined by the side extending between top right corner 204 and bottom right corner 208. L is defined as the distance extending between top side 210 and bottom side 212. W is defined as the distance extending between left side 214 and right side 216. In embodiments where the surface area of the origami envelope comprises approximately one-quarter of a surface area of unfolded sheet 200, W is greater than or equal to one-half of L. W and L may be any suitable length for constructing an origami envelope. FIG. 28 also shows the dimensions (relative to dimensions W and L) of each of the sides of the geometrical regions created from the folding down along each of first fold line 230, second fold line 234, third fold line 238, fourth fold line 242 and fifth fold line 246.

Figure 21:
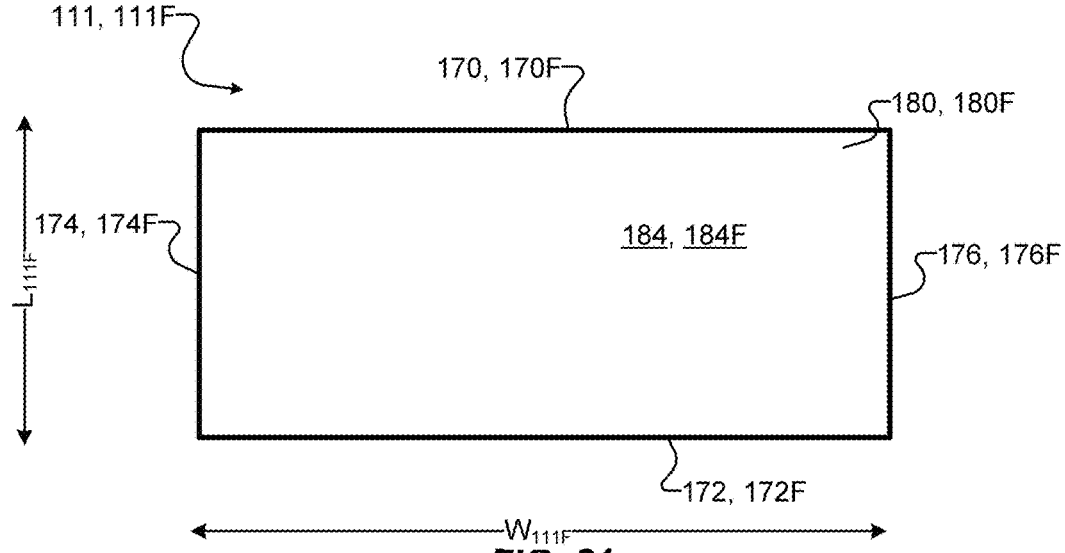
FIG. 21 is a top front view of a folded configuration of an origami envelope in accordance with an embodiment of the invention.
Figure 22:
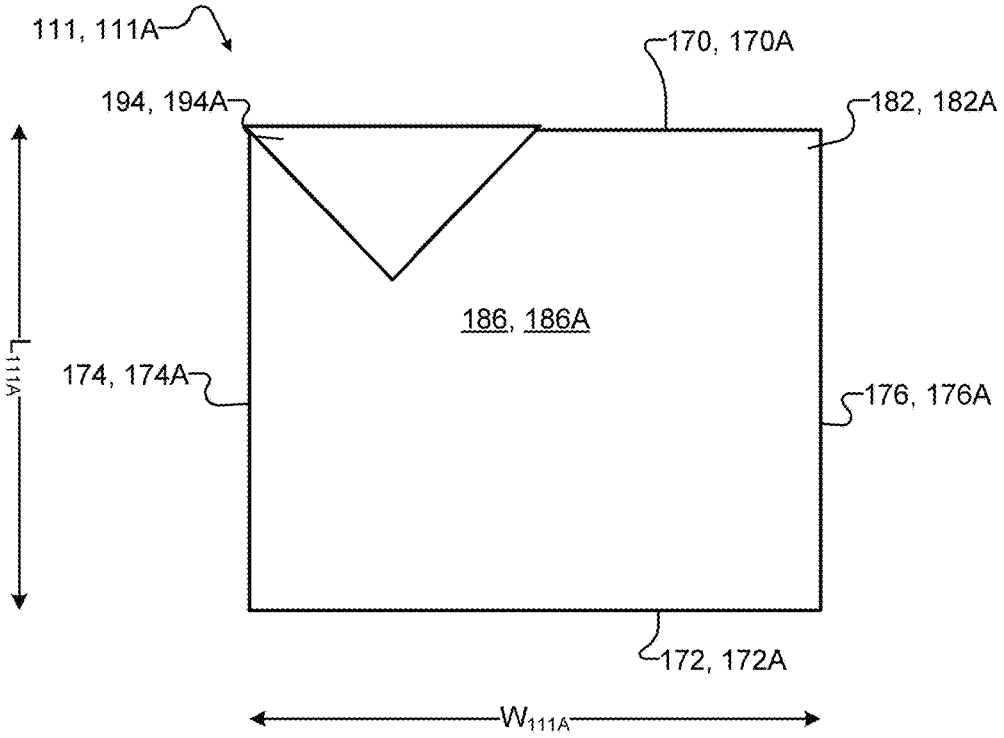
FIG. 22 is a top back view of a folded configuration of an origami envelope in accordance with an embodiment of the invention.
Figure 23:
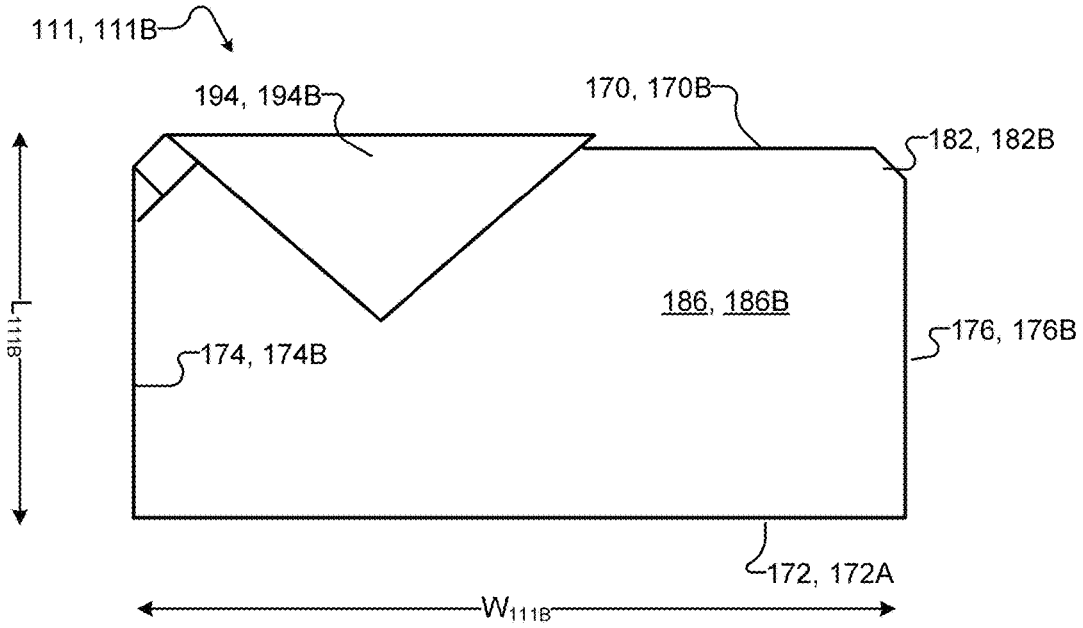
FIG. 23 is a top back view of a folded configuration of an origami envelope in accordance with an embodiment of the invention.
Figure 24:
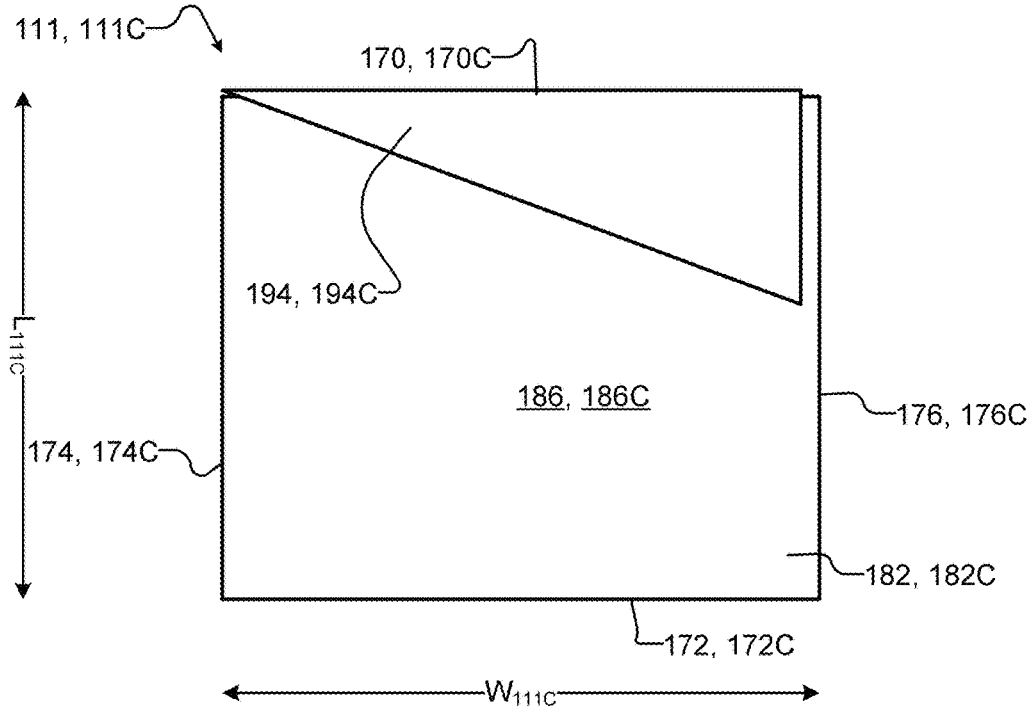
FIG. 24 is a top back view of a folded configuration of an origami envelope in accordance with an embodiment of the invention.
Figure 25:
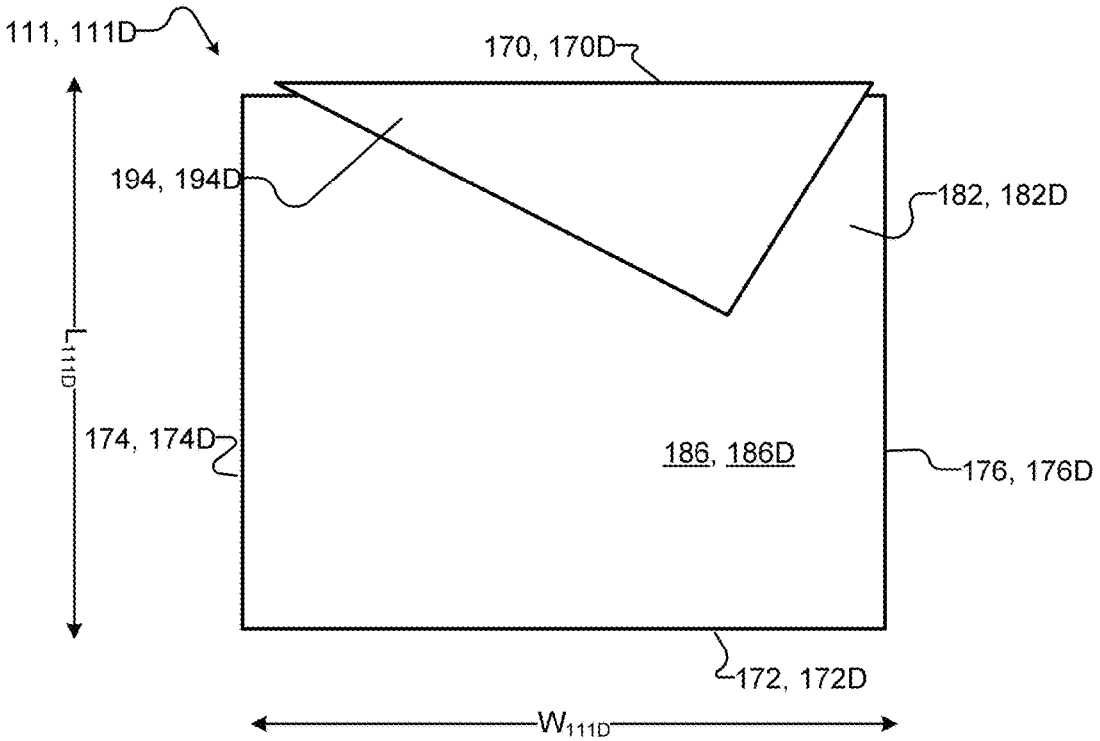
FIG. 25 is a top back view of a folded configuration of an origami envelope in accordance with an embodiment of the invention.
Figure 26:
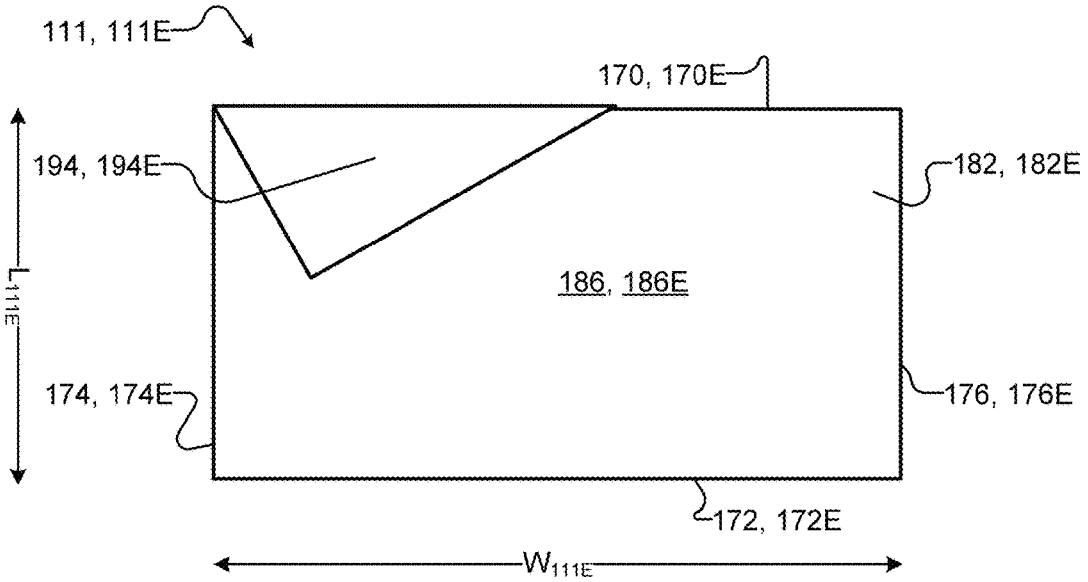
FIG. 26 is a top back view of a folded configuration of an origami envelope in accordance with an embodiment of the invention.
Figure 27:
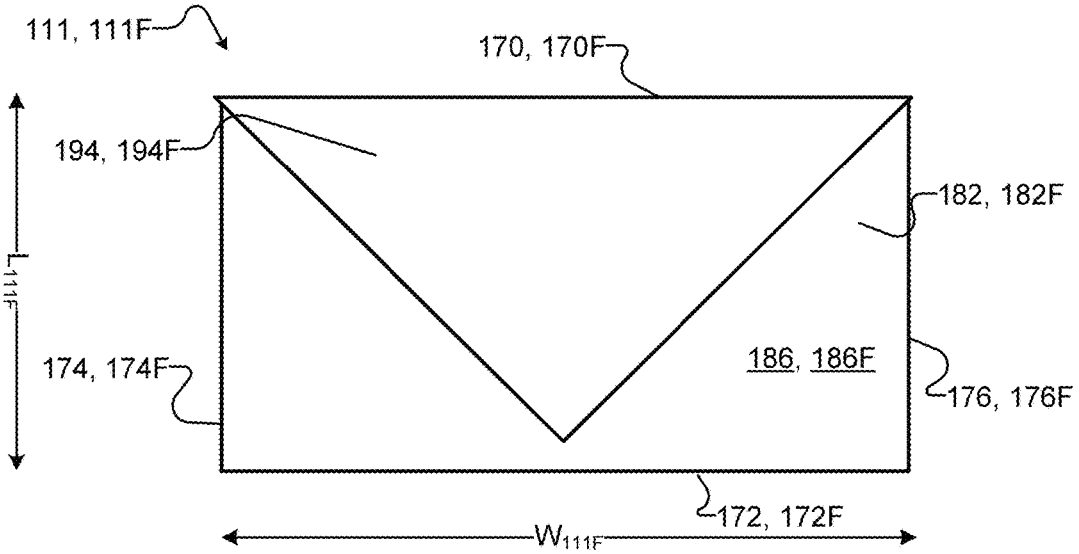
FIG. 27 is a top back view of a folded configuration of an origami envelope in accordance with an embodiment of the invention.

Origami envelope 111 comprises a top layer 180 and a bottom layer 182 (see for example, FIG. 16 illustrating the top layer 180 and FIG. 22 illustrating the bottom layer 182). Top layer 180 comprises a front surface 184 and a back surface opposite to the front surface (not shown). Similarly, bottom layer 182 comprises an exterior surface 186 (shown in FIGS. 16 to 21) and an interior surface 188 opposite to exterior surface 186. In some embodiments, a ratio between a surface area of top layer 180 and a surface area of bottom layer 182 is more than or equal to 0.5.

Figure 20:
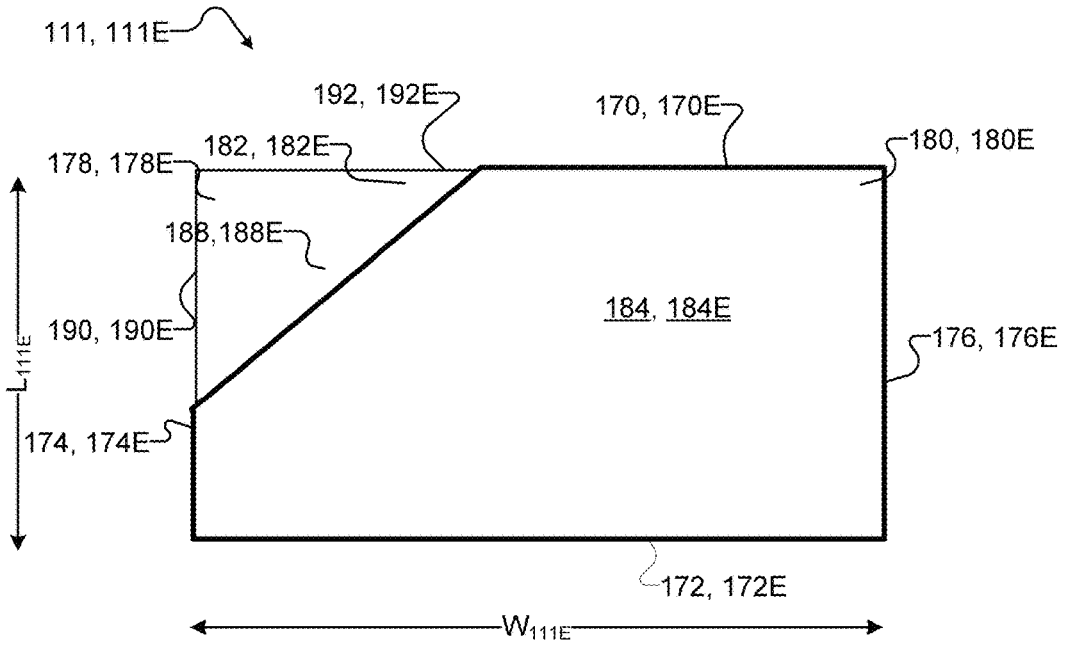
FIG. 20 is a top front view of a folded configuration of an origami envelope in accordance with an embodiment of the invention.

In particular embodiments, top layer 180 has a left envelope side which has a length that is shorter than a length of the right envelope side. In such embodiments, origami envelope 111 comprises a geometrical region 178 positioned at a top left corner of origami envelope 111. In some embodiments, geometrical region 178 comprises a triangular shape (as shown in FIGS. 16 and 20). In some embodiments, geometrical region 178 comprises a quadrilateral shape (as shown in FIG. 17). Geometrical region 178 comprises a length 190 and a width 192. Length 190 of geometrical region 178 is less than length $L_{111}$ of origami envelope 111, and width 192 of geometrical region 178 is less than width $W_{111}$ of origami envelope 111. In some embodiments, a ratio between length 190 of geometrical region 178 and length $L_{111}$ of origami envelope may be 0.10 to 0.80. In some embodiments, a ratio between width 192 of geometrical region 178 and width $W_{111}$ of origami envelope may be 0.1 to 0.50. In some embodiments, geometrical region 178 is created by extending top layer 180 of envelope 111 over a portion of top envelope side 170. The portion of top envelope side 170 may be equal to $W_{111}$ minus width 192 of geometrical region 178.

Figure 19:
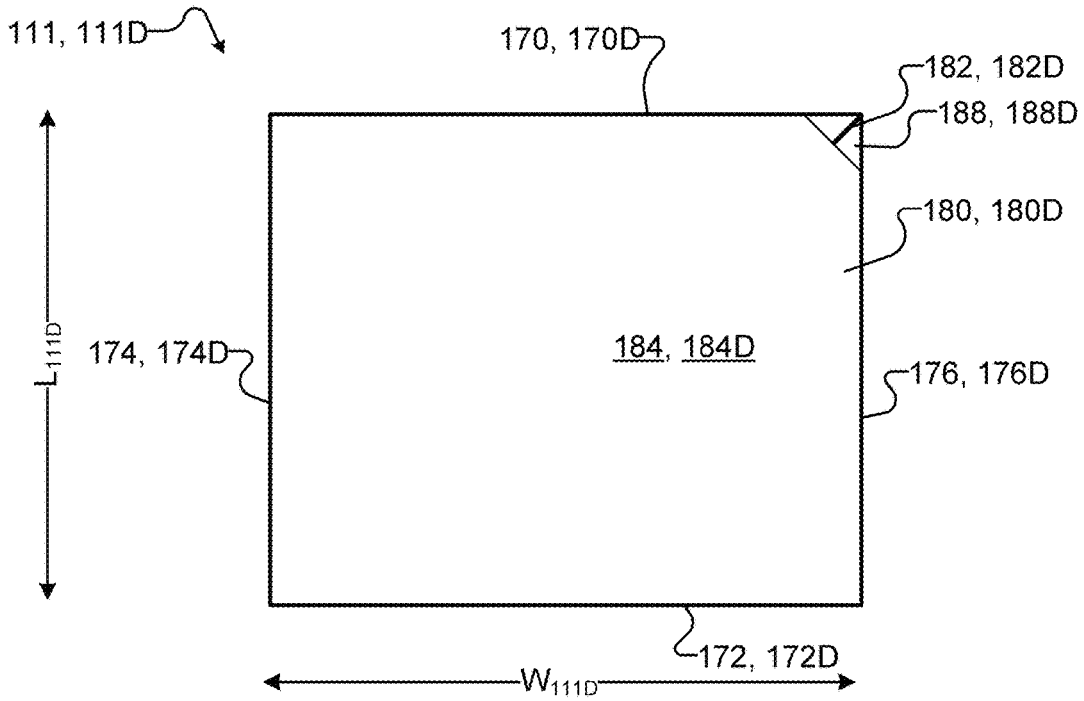
FIG. 19 is a top front view of a folded configuration of an origami envelope in accordance with an embodiment of the invention.

In some embodiments, origami envelope 111 does not comprise geometrical region 178. In such embodiments, top layer 180 may have a length at the left envelope side having a length that is substantially equal to a length of the right envelope side. This is best illustrated in FIGS. 18, 19 and 21.

FIGS. 22 to 27 show the back view of each of origami envelopes 111A, 1118, 111C, 111D, 111E and 111F (collectively and individually origami envelope 111) constructed from unfolded sheets 100A, 1008, 100C, 100D, 100E and 100F respectively. Each origami envelope 111 comprises a closure flap 194, similar in shape and function to closure flap 53 shown in FIG. 9. Closure flap 194 is constructed from folding down along fifth fold line 146, and by extending top layer 180 of envelope 111 over the portion of top envelope side 170 to exterior surface 186 of bottom layer 182. In the illustrated embodiments, closure flap 194 comprises a triangular shape. In some embodiments, closure flap 194 is a right triangle. In other embodiments, closure flap 194 may comprise other suitable geometrical shapes such as quadrilateral shapes.

While a number of exemplary aspects and embodiments have been discussed above, those of skill in the art will recognize certain modifications, permutations, additions and sub-combinations thereof. It is therefore intended that the scope of the claims should not be limited by the preferred embodiments set forth in the examples, but should be given the broadest interpretation consistent with the description as a whole.

What is claimed is:

1. An origami envelope formed from a sheet of material having a top edge extending between a top left corner and a top right corner, a bottom edge opposite to the top edge, extending between a bottom left corner and a bottom right corner, a first side extending between the top left corner and the bottom left corner, and a second side opposite to the first side, extending between the top right corner and the bottom right corner, the origami envelope comprising:

a top envelope side and a bottom envelope side opposite to the top envelope side, a left envelope side and a right envelope side opposite to the left envelope side, a top layer having a front surface and a back surface opposite to the front surface, and a bottom layer having an exterior side and an interior side opposite to the exterior side, wherein the back surface of the top layer is in contact with the interior side of the bottom layer, and wherein the top layer extends to the exterior side of the bottom layer over a portion of the top envelope side to form a closure flap at the exterior side of the bottom layer, each of the top and bottom edges having a first length, each of the first and second sides having a second length, the second length being longer than the first length.

2. The origami envelope of claim 1, wherein a length of the left envelope side is shorter than a length of the right envelope side at the front surface of the top layer.

3. The origami envelope of claim 1, wherein the left envelope side and the right envelope side have the same length at both the top and bottom layers.

4. The origami envelope of claim 1, wherein the origami envelope has a quadrilateral shape.

5. The origami envelope of claim 1, wherein a ratio between the portion of the top envelope side and the top envelope side ranges from approximately 0.05 to approximately 1.00.

6. The origami envelope of claim 1, wherein the origami envelope is constructed from the sheet of material having at least five fold lines, wherein the five fold lines create at least eight geometric regions on the sheet of material.

7. The origami envelope of claim 6, wherein the at least five fold lines comprise a first fold line, a second fold line, a third fold line, a fourth fold line and a fifth fold line, wherein the first and third fold lines are positioned apart and parallel to each other and the second, fourth and fifth fold lines are positioned apart and parallel to each other and perpendicular to each of the first and second fold lines.

8. The origami envelope of claim 1, wherein the envelope comprises a rectangular surface area, the rectangular surface area being approximately one-quarter of a surface area of the sheet of material.

9. The origami envelope of claim 6, wherein the at least five fold lines comprises:

a first fold line extending diagonally between a first side point positioned at one of the first and second sides and a first edge point positioned at one of the top and bottom edges;

a second fold line extending diagonally between a second side point positioned adjacent the first side point and a second edge point positioned at the edge opposite to the edge having the first edge point;

a third fold line extending diagonally between a first endpoint positioned adjacent to the second edge point and a third side point positioned at the side opposite to the first and second side points;

a fourth fold line extending diagonally between a second endpoint and a third endpoint, wherein an orthogonal projection of the second endpoint onto the first fold line is located between the first edge point and the first side point and the orthogonal projection of the third endpoint onto third fold line is located between the first endpoint and the third side point;

a fifth fold line extending diagonally between a fifth edge point positioned adjacent to the first edge point and a sixth side point positioned at the same side as one of the top or bottom corners; and wherein the sheet of material is oriented such that the top and bottom edges extend width wise, and the first and second sides extend length wise.

10. The origami envelope of claim 9, wherein the first side point coincides with the second side point.

11. The origami envelope of claim 9, wherein the first edge point coincides with the fifth edge point.

12. The origami envelope of claim 9, wherein the first endpoint is positioned either at the edge having the second edge point and adjacent to the second edge point or at the side having the first side point and adjacent to the first side point.

13. The origami envelope of claim 9, wherein the second endpoint is positioned either at the edge having the first edge point and adjacent to the first edge point or at the side having the first side point and adjacent to the first side point.

14. The origami envelope of claim 9, wherein the third endpoint is either positioned at the edge having the second edge point and adjacent to the second edge point or positioned at the side having the third side point and adjacent to the third side point.

15. The origami envelope of claim 9, wherein the origami envelope is constructed from the sheet of material by at least five folding steps, the at least five folding steps comprising:

folding the sheet of material along the first fold line to create a first substantially triangular region;

folding the sheet of material along the second fold line to create a second substantially triangular region;

folding the sheet of material along the third fold line to create either a quadrilateral region or a substantially triangular region;

folding the sheet of material along the fourth fold line to create the top and bottom layers and a closure flap extending from the top layer; and folding the sheet of material along the fifth fold line to extend the closure flap from the top layer over to the bottom layer.

* * * * *